US005307084A

United States Patent [19]

Yamaguchi et al.

[11] Patent Number: 5,307,084

[45] Date of Patent: Apr. 26, 1994

[54] METHOD AND APPARATUS FOR DRIVING A LIQUID CRYSTAL DISPLAY PANEL

[75] Inventors: Hisashi Yamaguchi, Atsugi; Yoshiya Kaneko, Tokyo; Munehiro Haraguchi, Hadano; Hiroshi Murakami, Atsugi; Takayuki Hoshiya, Atsugi; Tetsuya Kobayashi, Sagamihara; Kazuhiro Takahara, Atsugi, all of Japan

[73] Assignee: Fujitsu Limited, Kanagawa, Japan

[21] Appl. No.: 863,379

[22] Filed: Apr. 3, 1992

Related U.S. Application Data

[63] Continuation of Ser. No. 453,514, Dec. 20, 1989, abandoned.

[30] Foreign Application Priority Data

| | | | |
|---|---|---|---|
| Dec. 23, 1988 | [JP] | Japan | 63-327287 |
| Dec. 29, 1988 | [JP] | Japan | 63-331477 |
| Feb. 15, 1989 | [JP] | Japan | 1-36977 |
| Jun. 19, 1989 | [JP] | Japan | 1-157535 |

[51] Int. Cl.[5] ..... G09G 3/36

[52] U.S. Cl. ..... 345/58; 345/87

[58] Field of Search ..... 340/784, 765, 805; 358/230, 236, 241

[56] References Cited

U.S. PATENT DOCUMENTS

| | | | |
|---|---|---|---|
| 3,955,187 | 5/1976 | Bigelow | 340/784 |
| 4,485,380 | 11/1984 | Soneda et al. | 340/784 |
| 4,613,854 | 9/1986 | Holz et al. | 340/805 |
| 4,640,582 | 2/1987 | Oguchi et al. . | |
| 4,743,096 | 5/1988 | Wakai et al. | 340/784 |
| 4,845,482 | 7/1989 | Howard et al. | 340/784 |
| 4,892,389 | 1/1990 | Kuijk | 340/784 |
| 4,926,168 | 5/1990 | Yamamoto et al. | 340/784 |
| 5,010,326 | 4/1991 | Yamazaki et al. | 340/784 |

FOREIGN PATENT DOCUMENTS

| | | |
|---|---|---|
| 0288168 | 10/1988 | European Pat. Off. . |
| 2615993 | 12/1988 | France . |

OTHER PUBLICATIONS

Patent Abstracts of Japan, vol. 13, No. 47, p. 822, Feb. 3, 1988; JP-A-63240528.

Patent Abstracts of Japan, vol. 13, No. 12, p. 812, Jan. 12, 1989; JP-A-63220228.

Patent Abstracts of Japan, vol. 12, No. 144, p. 697, May 6, 1988; JP-A-62264029.

Patent Abstracts of Japan, vol. 9, No. 79, p. 347, Apr. 9, 1985; JP-A-59210421.

*Primary Examiner*—Ulysses Weldon

*Assistant Examiner*—M. Fatahiyar

*Attorney, Agent, or Firm*—Armstrong, Westerman, Hattori, McLeland & Naughton

[57] ABSTRACT

In a driver circuit of direct drive matrix type LCD panel, a quantity of ON-STATE cells (or OFF-STATE cells) displayed on the just previous scan electrode is counted and a quantity of ON-STATE cells (or OFF-STATE cells) to be displayed on a present scan electrode is also counted. A compensation voltage is generated according to a predetermined relation based on a difference of the two above-counted quantities, and is superposed onto drive voltages of unselected scan electrodes or of each of data electrodes, in a polarity that an undesirable spike voltage induced on unselected cell voltage is cancelled, in synchronization with selection of the present scan electrode. The compensation voltage may be generated according to a digital difference of the two quantities or to a change in an analog voltage representing the counted quantity. The above-described relation of the compensation voltage versus the counted quantity difference may be proportional or may be given with a predetermined specific relation to meet the panel characteristics. The compensation voltage may be a flat voltage during the period for selecting the single scan electrode or may be of a spike waveform. Amplitude of this spike is determined by the above-described predetermined relation. An irregular panel brightness caused from spike voltages induced from data electrode voltage application is cancelled.

8 Claims, 18 Drawing Sheets

POSITIVE VOLTAGE APPLICATION MODE

FIG. 2(a)

| | | | DATA ELECTRODE VOLTAGE | |
|---|---|---|---|---|
| | | | ON-STATE | OFF-STATE |
| | | | V | (1-2/a)V |
| SCAN ELECTRODE VOLTAGE | SELECTIVE | 0 | V | (1-2/a)V |
| | UN-SELECTIVE | (1-1/a)V | V/a | -V/a |

NEGATIVE VOLTAGE APPLICATION MODE

FIG. 2(b)

| | | | DATA ELECTRODE VOLTAGE | |
|---|---|---|---|---|
| | | | ON-STATE | OFF-STATE |
| | | | 0 | (2/a)V |
| SCAN ELECTRODE VOLTAGE | SELECTIVE | V | -V | -(1-2/a)V |
| | UN-SELECTIVE | V/a | -V/a | V/a |

FIG.3A X1
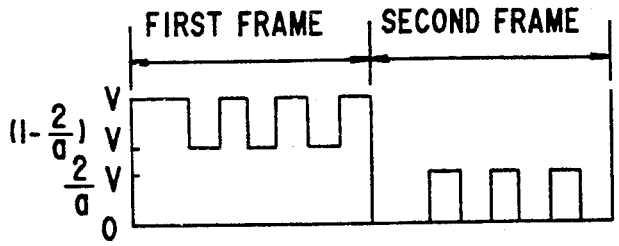
FIG.3B X2
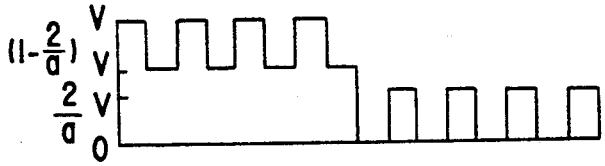
FIG.3C Y1
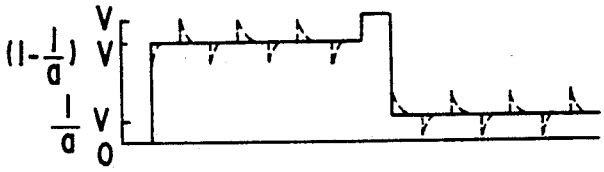
FIG.3D Vd
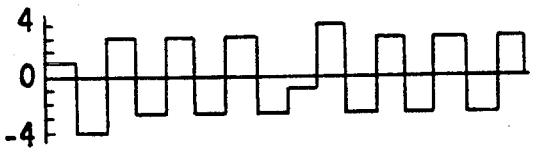
FIG.3E DP
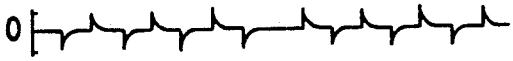
FIG.3F DP'
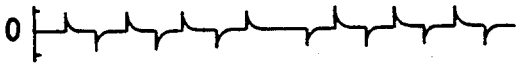
FIG.3G V2
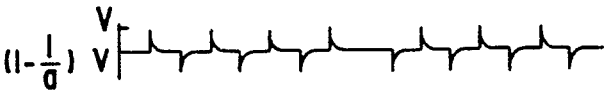
FIG.3H V5
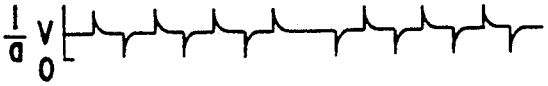

FIRST FRAME
SECOND FRAME

X1

X2

Y1

Vd

Cp

Dp'

V2

V5

X1-Y1 (CELL A)

X2-Y1 (CELL B)

FIRST FRAME
SECOND FRAME

X1

X2

Y1

Vd2

Dp2

Dp'2

V2

V5

X1-Y1
(CELL A)

X2-Y1
(CELL B)

FIRST FRAME
SECOND FRAME

X1

X2

Y1

Y1'

Y1-Y1'

V2

V5

X1-Y1
(CELL A)

X2-Y1
(CELL B)

METHOD AND APPARATUS FOR DRIVING A LIQUID CRYSTAL DISPLAY PANEL

This application is a continuation of application Ser. No. 453,514 filed Dec. 20, 1989 now abandoned.

BACKGROUND OF THE INVENTION

1. Field of the Invention

The present invention relates to methods and circuit configuration for driving a liquid crystal display panels of direct drive type.

2. Description of the Related Art

In driving methods of liquid crystal display devices, there are two major categories, i.e. a direct drive matrix type and an active matrix type. The active matrix type experiences difficulties in its production because active elements are required on every picture element at intersections of the matrix. Therefore, the direct drive matrix type has been widely employed for display panels having a large number of the picture elements.

It is widely known that in the liquid crystal display panel of the direct drive matrix, when data pulse voltages are applied onto selected data electrodes an undesirable spike voltage is induced on the unselected scan electrodes facing the data electrodes, through electrostatic capacitances of liquid crystal cells (referred to hereinafter as cells) connected to the data electrodes. The spike voltage is caused by differentiation of the change in the applied data pulse voltages by the cell capacitances. Optical transparency of each cell corresponds to an effective value, i.e. a square root of sum of squares of applied cell voltages for the voltage application period. Thus induced spike voltages on the unselected scan electrodes cause a cross-talk, i.e. non-uniformity, to develop on the display panel. Recent trend of increase in electrodes quantity on a larger panel causes not only an increase in electrical resistance of transparent electrodes but also a decrease in difference of the applied cell voltage to select an ON-STATE of the cell, where the cell is most transparent by an application of cell voltages, from a voltage to select an OFF-STATE, where the cell is least transparent by the least application of the cell voltages. Therefore, the cross-talk has been becoming more and more serious problem.

In order to eliminate the effect of such undesirably induced spike voltages, some methods have been proposed as described below. In Japanese un-examined patent publication Sho 63-240528, there is disclosed an idea that a compensation voltage is applied to unselected electrodes. However, none of its practical means is disclosed therein. In Japanese un-examined patent publication Sho 63-220228, there is disclosed a method that a voltage corresponding to the display data on a selected scan electrode is fed back to unselected scan electrodes. However, in these methods, it is impossible to compensate a cross-talk on the display which is caused from a change in the quantity of ON-STATE cells when the scan goes to a presently selected scan electrode from the just previously selected scan electrode.

SUMMARY OF THE INVENTION

It is a general object of the invention, therefore to provide methods and circuit configuration to cancel a cross-talk which develops on cells on unselected scan electrodes, caused from a change in the quantity of ON-STATE cells when the scan moves to a presently selected scan electrode from the just previously selected scan electrode.

In a method of the present invention, a quantity of ON-STATE cells (or OFF-STATE cells) displayed on the just previous scan electrode is counted and a quantity of ON-STATE cells (or OFF-STATE cells) to be displayed on a present scan electrode is counted. A compensation voltage is generated according to a predetermined relation based on a difference of the two above-counted quantities, and is superposed onto drive voltages of unselected scan electrodes or of each of data electrodes, in a polarity that an effect of undesirable spike voltages induced on the unselected cell voltages are cancelled, in synchronization with selection of the present scan electrode.

The above-described relation of the compensation voltage versus the counted quantity difference may be proportional or may be given with a predetermined specific relation to meet the panel characteristics. The compensation voltage may be a DC voltage during the period for selecting the single scan electrode or may be of a spike waveform. Amplitude of this spike is determined by the above-described predetermined relation.

The above-mentioned features and advantages of the present invention, together with other objects and advantages, which will become apparent, will be more fully described hereinafter, with reference being made to the accompanying drawings which form a part hereof, wherein like numerals refer to like parts throughout.

BRIEF DESCRIPTION OF THE DRAWINGS

FIGS. 2*a–b* show voltages to be applied upon scan and data electrodes according to an optimized amplitude selection method;

FIGS. 3*a–j* show voltage waveforms in the circuit of the FIG. 1 first preferred embodiment;

DETAILED DESCRIPTION OF THE PREFERRED EMBODIMENTS

Referring to drawings, preferred embodiments of the present invention are hereinafter described in detail.

Figure 1:
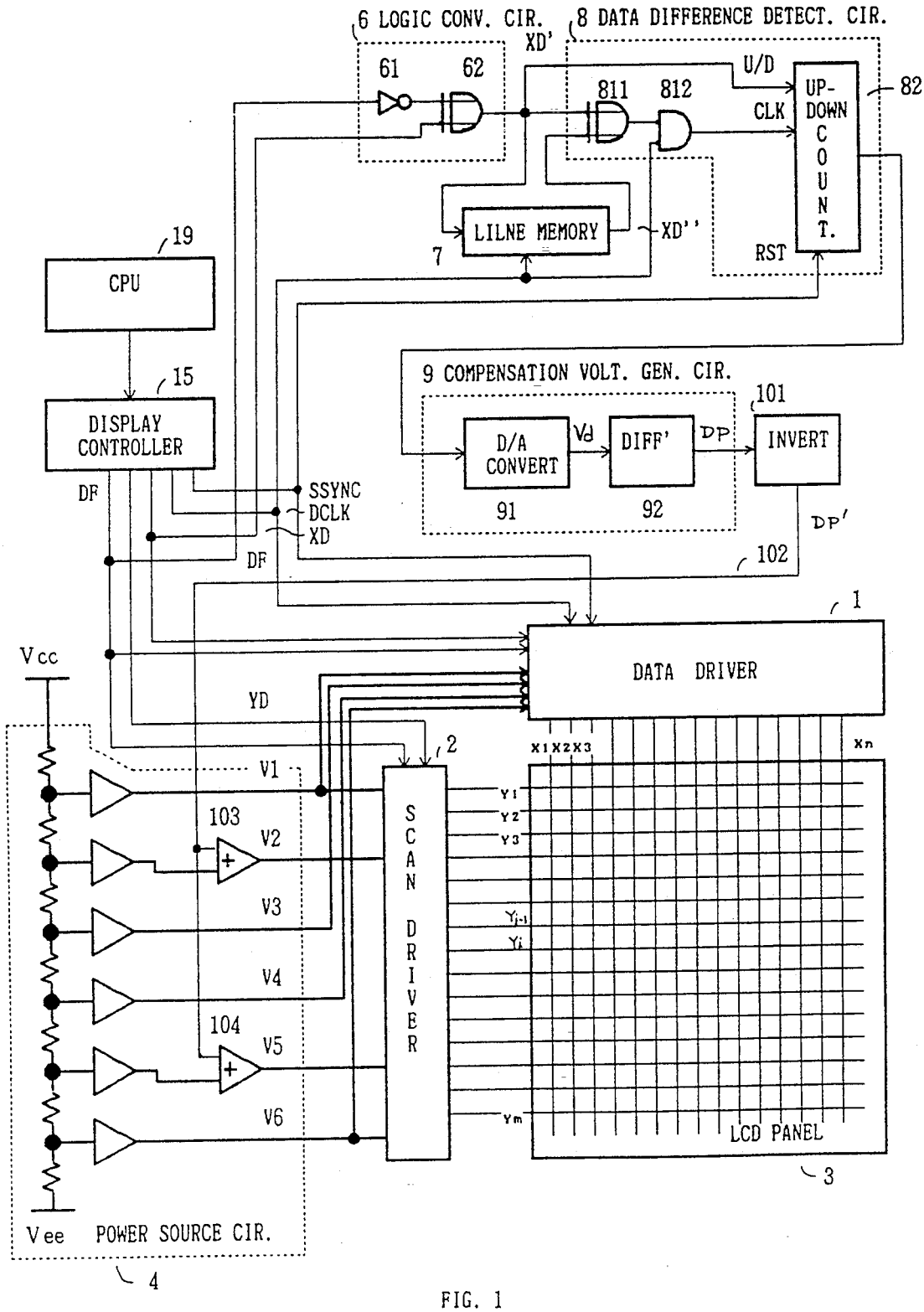
FIG. 1 is a block diagram of a first preferred embodiment of the present invention.

FIG. 1 shows a first preferred embodiment of the present invention. Data electrodes $X_l \sim X_n$ and scan electrodes $Y_l \sim Y_m$ form a matrix configuration for a liquid crystal display panel (referred to hereinafter as panel) 3, and are connected to a data driver 1 and scan driver 2, respectively. A cell located at an intersection of a scan electrode and data electrode becomes ON-STATE by application of the below-described selective cell voltages onto the crossing two electrodes, and becomes OFF-STATE by application of the below-described unselective cell voltages thereto. Thus, the cell is distinguished to optically display the data given thereto. Data driver 1 is supplied with DC (direct current) voltages, V volts ($V_1$), (1-2/a)V volts ($V_3$), (2/a)V volts ($V_4$) and 0 volt ($V_6$), from power source circuit 4. Scan driver 2 is supplied with DC voltages, outputting V volts ($V_1$) and 0 volt ($V_6$) directly from power source circuit 4 and DC voltages (1-1/a)V volts ($V_2$) and (1/a)V volts ($V_5$) from power source circuit 4 via first input terminals of adder circuits 103 and 104, respectively. The amount of the constant "a" included in the above-described voltages will be explained later on.

A display controller 15, outputs to data driver 1 an X data (a display signal) XD to be displayed on the liquid crystal panel 3 and to scan driver 2 a Y data (a scan signal) YD to sequentially select one of the scan electrodes, in response to an instruction given from a main controller 19, such as a CPU (central processing unit). Data driver 1 and scan driver 2 selectively output one of the above-described selective and unselective voltages received from the power source circuit 4 to each of the data electrodes $X_l \sim X_n$ and scan electrodes $Y_l \sim Y_m$, respectively, in response to the X data and Y data. Selection of these voltages will be described later on. The X data to be displayed on the scan electrodes is serially input from the display controller 15, and is once latched in a shift-register (not shown in the figure) provided in the data driver 1 and is output in a parallel form in synchronization with the selection of a scan electrode $Y_i$ on which the X data $XD_i$ is to be displayed.

In the present invention, a well-known Optimized Amplitude Selection Method which was reported by Allen R. Kmetz on Seminar Lecture Note, page 7.2-2 to 7.2-24, for the Society of Information Display, 1984, is employed so that the liquid crystal cells are prevented from deterioration of display characteristics by eliminating a residual DC voltage on the cells. That is, a positive voltage application mode where the selective cell voltage defined with respect to the scan electrode potential is positive, and a negative voltage application mode where the cell voltage is negative with respect to the scan electrode potential, are alternately switched in a predetermined cycle. This switching cycle is, for example, each frame (a screen) or several scan electrodes. In the preferred embodiments of the present invention, the frame cycle is selected as the switching cycle. Application voltages onto the scan and data electrodes in the positive and voltage application modes are respectively shown in FIG. 2(*a*) and FIG. 2(*b*), where the voltages enclosed by dotted lines indicate cell voltages with respect to the scan electrode. A constant "a" included in the formulas representing the application voltages is given by a formula, $a=\sqrt{N+1}$, where N indicates the quantity of the scan electrodes. Therefore, in the present preferred embodiment where the quantity of the scan electrodes is 400, a=21, the selective voltage V in FIGS. 2 is 36.2 volts depending on the quantity of the scan electrodes and on the liquid crystal material used in the panel. Accordingly, the voltages $V_2$, $V_3$, $V_4$, and $V_5$ each defined by the formulas including the constant "a" are 0.95 V volts, 0.90 V volts, 0.10 V volts and 0.05 V volts, respectively. $V_6$ is 0 volt. The voltages $V_1$ to $V_5$ are provided from a positive power source voltage Vcc and a negative power source voltage Vee, through divider resistors.

In driving the panel 3 in the positive voltage application mode the data driver 1 applies the voltage V onto data electrode(s) to be selected (i.e. to become ON-STATE) and the voltage (1-2/a)V volts ($V_3$) to data electrode(s) to be unselected (i.e. to become OFF-STATE) depending on the received X data XD, while the scan driver 2 applies 0 volt onto a scan electrode to be selected as well as (1-1/a)V volts ($V_2$) onto all other unselected scan electrodes. In driving the panel 3 in the negative voltage application mode the data driver 1 applies 0 volt onto selected data electrode(s) and the voltage (2/a)V volts ($V_4$) to unselected data electrode(s), while the scan driver 2 applies V volts onto a selected scan electrode as (1/a)V volts onto all other unselected scan electrodes.

Display controller 15 has an output terminal 151 to output a frame signal (i.e. a mode selecting signal) DF which selects the voltage application mode in the predetermined cycle, each time a transmission of the single frame data is completed. The mode selecting signal DF is input to data driver 1, scan driver 2, and an inverter 61 comprised in a below-described logic converter 6, respectively. Data driver 1 and scan driver 2 are set in the positive voltage application mode by, for example, logic level 1 of the mode selecting signal DF and the negative voltage application mode by the logic level 0.

When a scan electrode $Y_i$ is going to be selected, X data $XD_i$ to be displayed on this scan electrode $Y_i$ are serially output from the display controller 15, then, the X data $XD_i$ is input to both the data driver 1 and the logic converting circuit 6. In the figures, suffix "i" and "i-1" indicating the scan electrode number are omitted from XD, XD', XD'' denoting the X data. Data driver 1 latches the X data $XD_i$, and outputs the latched data $X_i$ when the scan electrode $Y_i$ is selected by an application of selective scan voltages, as described above. Logic converting circuit 6 converts an ON-STATE signal and OFF-STATE signal each in the X data $XD_i$ according to the below-described routine. Logic converting circuit 6 comprises an inverter 61 and an exclusive OR gate 62. Inverter 61 is input with the mode selecting signal DF as described above, and the exclusive OR gate 62 is input with the output of the inverter 61 and the X data $XD_i$. Because the mode selecting signal DF is inverted by the inverter 61, logic level "1" in the X data $XD_i$ for scan electrode $Y_i$ is output as it is from the logic converting circuit 6 to the exclusive OR gate 811, without being converted during the positive voltage application mode; in other words, an ON-STATE signal is output as logic "1" level from the logic converting circuit 6 and an OFF-STATE signal as logic level "0". On the contrary, during the negative voltage application mode, an ON-STATE signal, i.e.

logic level "1", is output as logic level "0" and an OFF-STATE signal, i.e. logic level "0", is output as logic level "1" from the logic converting circuit 6.

A line memory 7 composed of a shift register has received and is now storing X data $XD_{i-1}'$ displayed on the just previous scan electrode $Y_{i-1}$ output from the logic converting circuit 6 in response to a data synchronizing signal (a clock signal) DCLK output from the display controller 15. A data difference detection circuit 8 comprises the exclusive OR gate 811, AND gate 812 and an up-down counter 82. The exclusive OR gate 811 is input with the output $XD_i'$ from the logic converting circuit 6 and an output $XD_{i-1}''$ for the just previous scan electrode $Y_{i-1}$ from the line memory 7, and compares the input logic levels of each of corresponding bits of two adjacent scan electrodes $Y_{i-1}$ and $Y_i$, so as to output logic level "1" when the compared logic levels are not identical. Thus, the quantity of ON-STATE or OFF-STATE cells in the X data $XD_i'$ and in the corresponding X data $XD_{i-1}''$ for the just previously selected scan electrode $Y_{i-1}$, are compared so that the quantity of cells whose data is changed is detected. In this comparison process, as described above, the quantity of ON-STATE cells is compared in the positive voltage application mode and the quantity of OFF-STATE cells is compared in the negative voltage application mode. Reading of the data in the line memory 7 is allowed by the data synchronizing signal DCLK in synchronization with writing the X data $XD_i'$ of the present scan electrode $Y_i$. AND gate 812 is input with an output of the exclusive OR gate 811 and the data synchronizing signal DCLK, so as to output a pulse when the output of the exclusive OR gate 811 is of logic level "1". The up-down counter 82 is input with this pulse output at its clock terminal CLK from the AND gate 812, and is input with a logic signal output from the logic converting circuit 6 at its up-down control terminal U/D. Thus, up-down counter 82 counts up when the output of the logic converting circuit 6 is of logic level "1", and counts down when the logic level is "0". Up-down counter 82 is also provided with a reset terminal RST, to which the scan synchronizing signal SSYNC for synchronizing the drive of the scan electrodes is input so that the counter output is reset to be zero prior to above-described application of the X data to the data electrodes on each cycle of driving the scan electrode. Thus, when a cell changes its display state from the X data $XD_{i-1}$ of just previous scan electrode $Y_{i-1}$ to the X data $XD_i$ of the presently selected scan electrode $Y_i$, logic level "1" is output from the logic converting circuit 6, so that up-down counter 82 counts down. Contrary, when logic level "0" is output therefrom, up-down counter 82 counts up. Therefore, the up-down counter 82 outputs a positive count number for representing a quantity of cells which have changed the display states into the logic level "1" and increased over the cell quantity having changed into the logic level "0". Contrarily when this quantity is decreased, up-down counter 82 outputs a negative number.

A compensation voltage generating circuit 9 comprises a well-known digital-to-analog converter (referred to hereinafter as D/A converter) 91 and a well-known differentiating circuit 92 comprising a capacitor and a resistor (neither shown in the figure). D/A converter 91 converts the counted number output from up-down counter 82 into a DC voltage Vd. Differentiating circuit 92 generates a spike pulse DP whose amplitude is substantially equal to the DC voltage Vd. The D/A converter 91 is devised so that the output of the D/A converter 91 is limited to be in a period which is shorter than the scan selection period but includes the front edge of the output pulse, though not shown in the figures. This spike pulse DP has the same polarity and same waveform as those of the undesirable spike pulses, induced on the scan electrodes, causing distortions of voltage waveforms applied to the cells. A feedback circuit comprises an inverter 101 which inverts the polarity of the spike pulse DP, and two adder circuit 103 and 104. An output of the inverter 101 is input to each of second input terminals of the adder circuits 103 and 104 via a feedback line 102, thus is superposed onto the unselective scan electrode voltages $V_2$ and $V_5$. These unselective scan electrode voltages are applied onto all other scan electrodes than the presently selected scan electrode $Y_i$. In synchronization with selecting the present scan electrode $Y_i$, the X data $XD_i$ being applied in parallel form to each of data electrodes induces the undesirable spike voltage on the scan electrodes, as described above. Then, the induced undesirable spike voltages are cancelled by the above-described compensation pulse DP'. In a practical circuit, the level of the fed-back compensation pulse may be adjusted, for example, with a variable potentiometer (which is not shown in the figure), while the display panel is visually observed, and fixed.

Figure 3I:
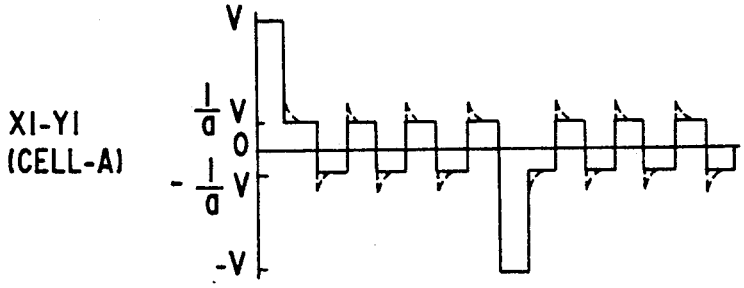
Figure 3J:
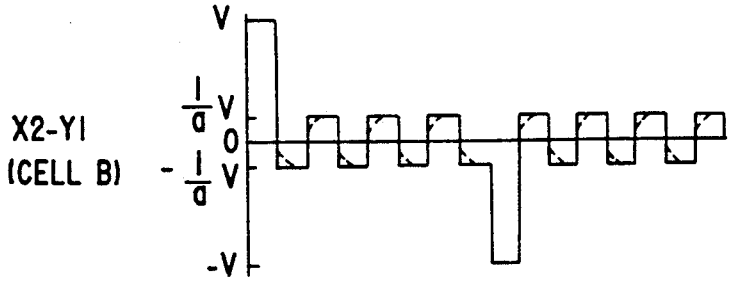
Figure 4:
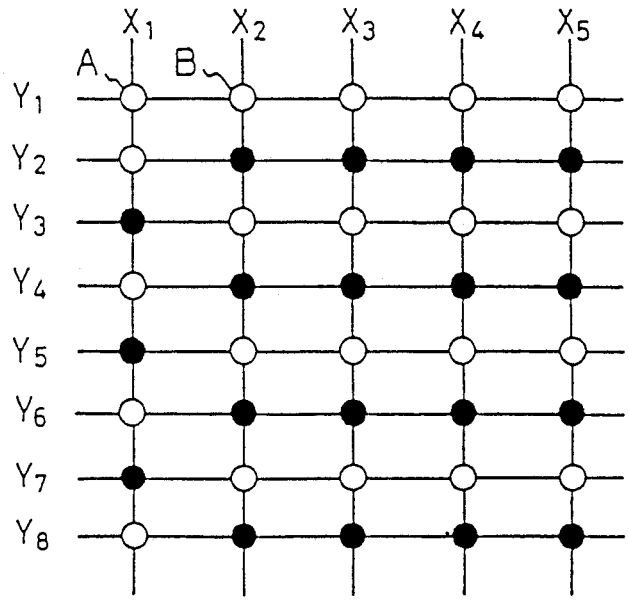
FIG. 4 is a pattern displayed by the waveforms shown in FIGS. 3.

Voltage waveforms generated in FIG. 1 circuit in displaying a pattern shown in FIG. 4 where a white dot indicates an ON-STATE cell, and a black dot indicates an OFF-STATE cell, are illustrated in FIG. 3, where the first frame is in the positive voltage application mode and the second frame is in the negative voltage application mode. Dotted lines shown there indicate the waveforms before the present invention is embodied thus including the undesirable spike pulse, and the solid lines indicate the waveforms after the present invention is embodied. As observed there, the undesirable spikes induced on the scan electrodes can be cancelled on selecting each of the scan electrodes. With the dotted line waveforms without embodying the present invention, the effective voltage value of the "A" cell voltage $(X_1-Y_1)$having spikes extending outwards is larger than the effective voltage value of the "B" cell voltage $(X_2-Y_1)$ having spikes sinking inwards, thus, the "A" cell was brighter than the "B" cell, that is, a cross-talk is taking place.

Figure 5:
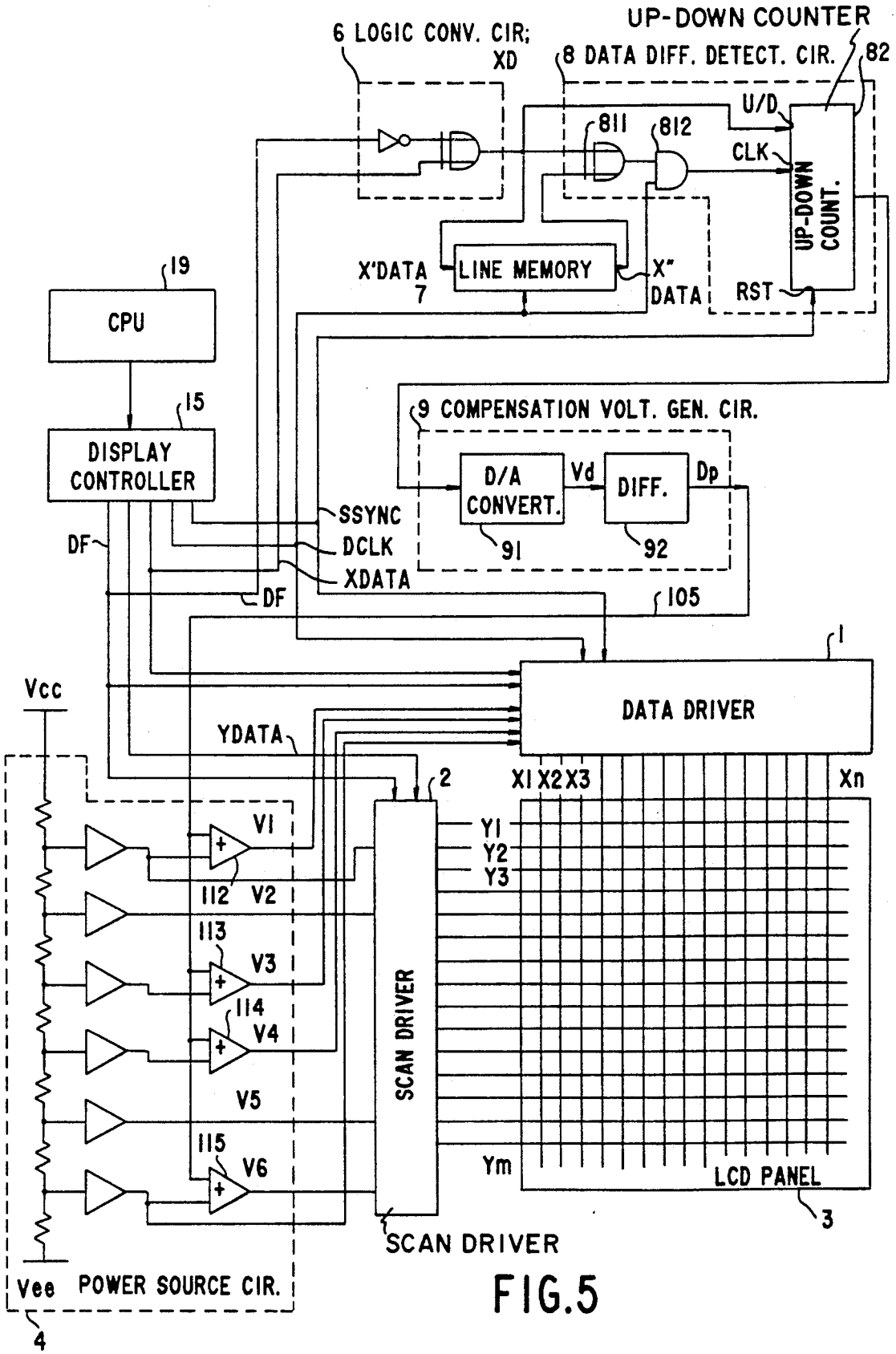
FIG. 5 is a block diagram of a second preferred embodiment of the present invention.

FIG. 5 shows a configuration of the second preferred embodiment of the present invention. The differences of the second preferred embodiment from the first preferred embodiment are in that the inverter 101 in the first preferred embodiment is omitted in the second preferred embodiment, and four adder circuits 112~115 are newly provided in feeder lines of the DC voltage sources $V_1$ and $V_6$ selecting the ON-STATE and the DC voltage sources $V_3$ and $V_4$ selecting the OFF-STATE, each connected to the data driver 1 instead of the scan driver 2. Accordingly, the compensation pulse fed back via a feedback line 105 to the data electrodes is of the same waveform having the same polarity and same amplitude as those of the undesirable spikes induced on the unselected scan electrodes. Therefore, the undesirable spike pulse does not appear on the unselected cell voltage being the difference of the data electrode voltage and the scan electrode voltage. Other circuit figurations being the same and performing the same as those of FIG. 2, are denoted with the same numerals, while no more explanation is given for each.

Figure 6:
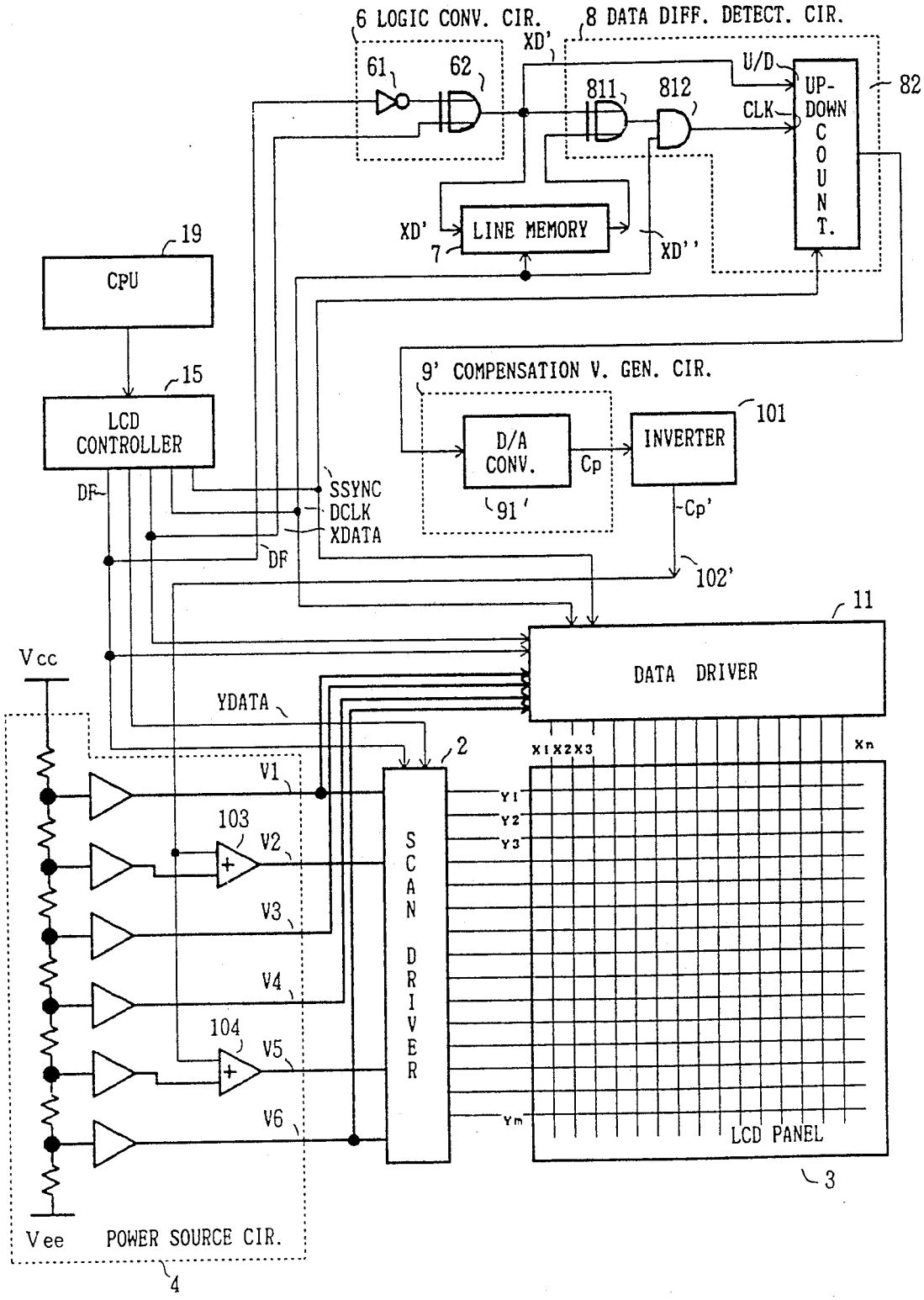
FIG. 6 is a block diagram of a third preferred embodiment of the present invention.
Figures 7A, 7B, 7C, 7D, 7E, 7F, 7G, 7H, 7I, 7J:
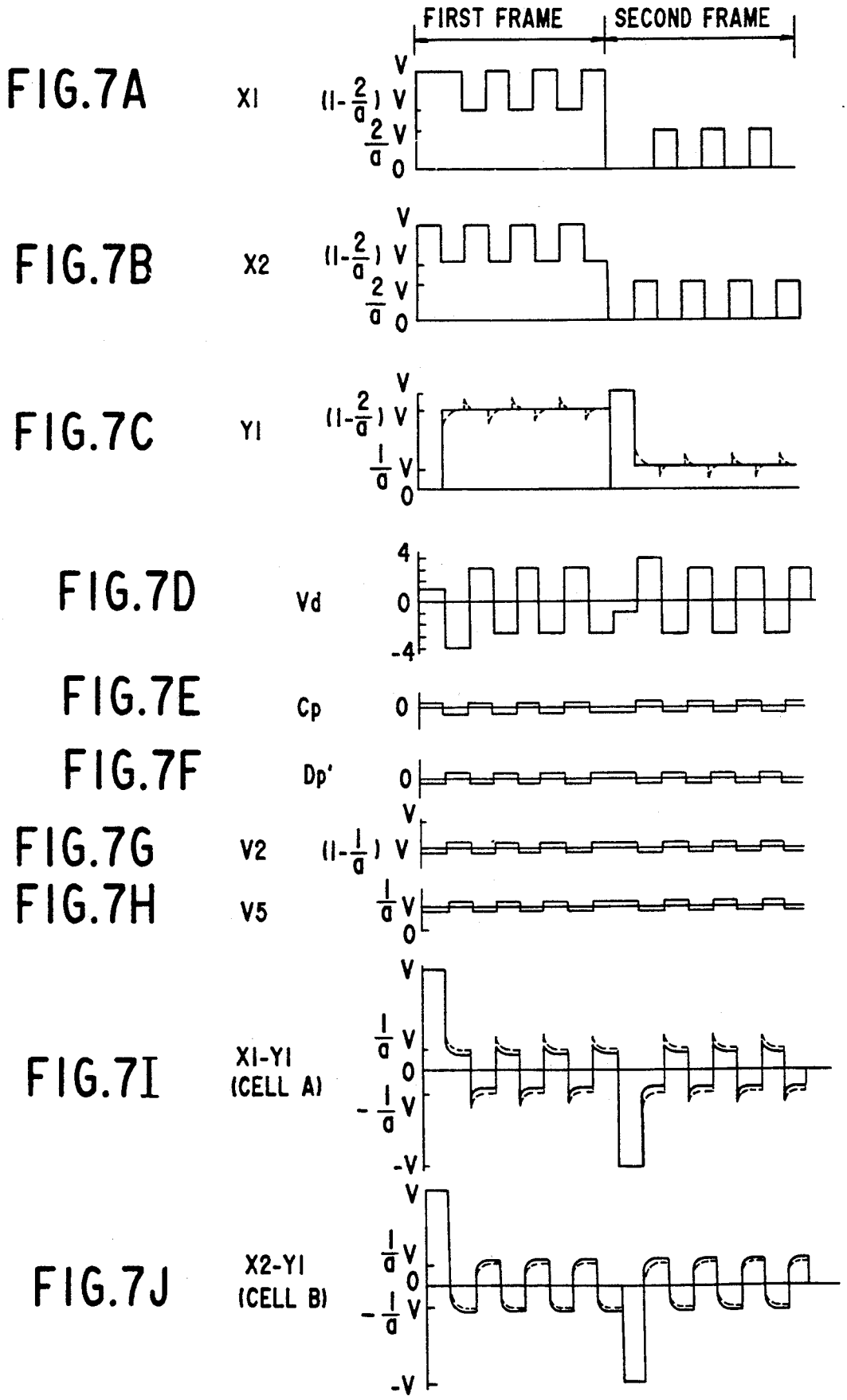
FIGS. 7A–J show voltage waveforms in the circuit of the FIG. 6 third preferred embodiment.

FIG. 6 shows the third preferred embodiment of the present invention. In the third preferred embodiment, in the compensation voltage generating circuit 9' the differentiating circuit 92 in the FIG. 2 compensation voltage generating circuit 9 has been deleted. DC output voltage $C_p$, which is constant during the scan electrode selection period, from the D/A converter 91' is inverted by an inverter amplifier 101. An output $C_p'$ of the inverter amplifier 101 is fed back via the feedback line 102 to the unselected scan electrodes during the period of selecting the present scan electrode $Y_i$. Voltage waveforms to display the pattern of FIG. 4 are illustrated in FIG. 7. According to this configuration, a DC voltage which is effectively equivalent, during the period of selecting a scan electrode, to the undesirable spike voltage is fed back to the source voltages $V_2$ and $V_5$. This is because, as described above, the optical transparency of the liquid crystal cell depends on the effective value of the cell voltage. In a practical circuit, the feedback level may be adjusted with a potentiometer (which is not shown in the figure) at an optimum condition while the display panel is visually observed, as described for the first preferred embodiment, and fixed. The circuit configuration of the third preferred embodiment gives an advantageous effect identical to that of the first or the second preferred embodiment while the circuit is simplified by deleting the differentiating circuit 92.

Furthermore, though not shown in a figure, a modification is apparently possible that the inverter 101 is deleted from the circuits of the FIG. 6 third preferred embodiment so that DC compensation voltage is fed back to the power source voltages of data driver 1, in the same way as the modification of the first preferred embodiment to the second preferred embodiment.

Figure 8:
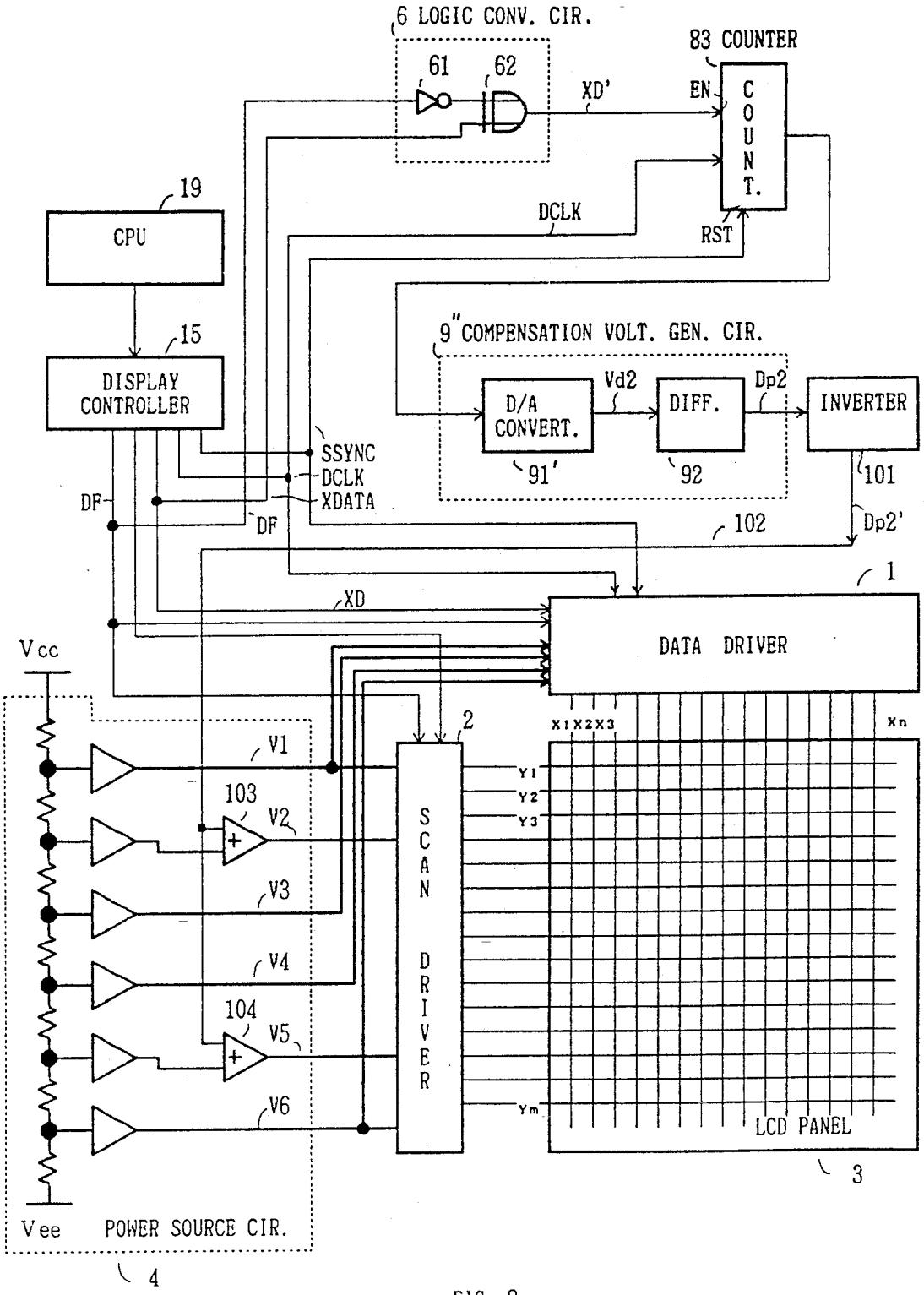
FIG. 8 is a block diagram of a fourth preferred embodiment of the present invention.

The fourth preferred embodiment of the present invention is shown in FIG. 8, where the compensation voltage is generated by an analog method instead of the first, second and third preferred embodiments, where the change in the display data is digitally provided by the counter. The fourth preferred embodiment is different from the first preferred embodiment in that the data difference detecting circuit 8 is replaced with a counter 83 and memory 7 is deleted. Accordingly, only the portions different from those of FIG. 1 first preferred embodiment are hereinafter described. Other circuits being the same as in FIG. 1 are denoted with the same numerals so as to give no more description thereon. Counter 83 is input with the data synchronizing signal DCLK as a clock signal from the display controller 15, and is input at first with the output $XD_{i-1}'$ of scan electrodes $Y_{i-1}$ from the logic converting circuit 6 at the enable terminal EN. Therefore, logical level "1" output from the logic converting circuit 6 enables counter 83 to count the data synchronizing signal DCLK. Counter 83 is further provided with a reset terminal RST to which the scan synchronizing signal SSYNC transmitted from the display controller 15 is input so as to initialize the count number, i.e. resets the count number zero, for every scan drive period. Therefore, counter 83 counts the quantity of the logic level "1" outputs (representing ON-STATE bits to be displayed on a scan electrode during the positive voltage application mode, as well as representing OFF-STATE bits during the negative voltage application mode) from the logic converting circuit 6. The logic converting circuit 6 and the counter 83 together constitute a determining means for determining the residual voltage on the unselected ones of the scan electrodes. Compensation voltage generating circuit 9" comprises D/A converter 91' and differentiating circuit 92. D/A converter 91' converts the count number of counter 83 to a DC voltage Vd2. Successively, counter 83 counts the quantity of the logic level "1" in X data $XD_i'$ to be displayed on the next, i.e. present, scan electrode $Y_i$ transmitted from the logic converting circuit 6, and outputs the counted number to the D/A converter 91' in synchronization with the application of scan electrode voltage to select the present scan electrode $Y_i$. Therefore, upon being input with the newly counted number, the DC output voltage Vd2 of the D/A converter 91' changes to a new DC voltage corresponding to the newly counted number for the scan electrode $Y_i$. Output voltage $V_{d2}$ of the D/A converter 91' is input to differentiating circuit 92, which differentiates the transition of the DC voltages $V_{d2}$ so as to output a spike pulse $DP_2$, which is a compensation signal. Spike pulse $DP_2$ is inverted by an inverting circuit 101. Amplitude of the spike pulse $DP_2'$ output from the inverting circuit 101 is proportional to the change in the DC voltage $V_{d2}$ output from the D/A converter 91', and has the same polarity and the substantially same shape as those of the undesirable spike pulse induced on the unselected scan electrodes. Thus, the amplitude of the compensation signal pulse is proportional to the change in the quantities of the ON-STATE cells on the just previous scan electrode $Y_{i-1}$ to the presently selected scan electrode $Y_i$, for the positive voltage application mode, as well as the quantity of OFF-STATE cells for the negative voltage application mode. The compensation signal is fed back to the unselected scan electrodes in the same way as the first preferred embodiment.

Figures 9A, 9B, 9C, 9D, 9E, 9F, 9G, 9H, 9I, 9J:
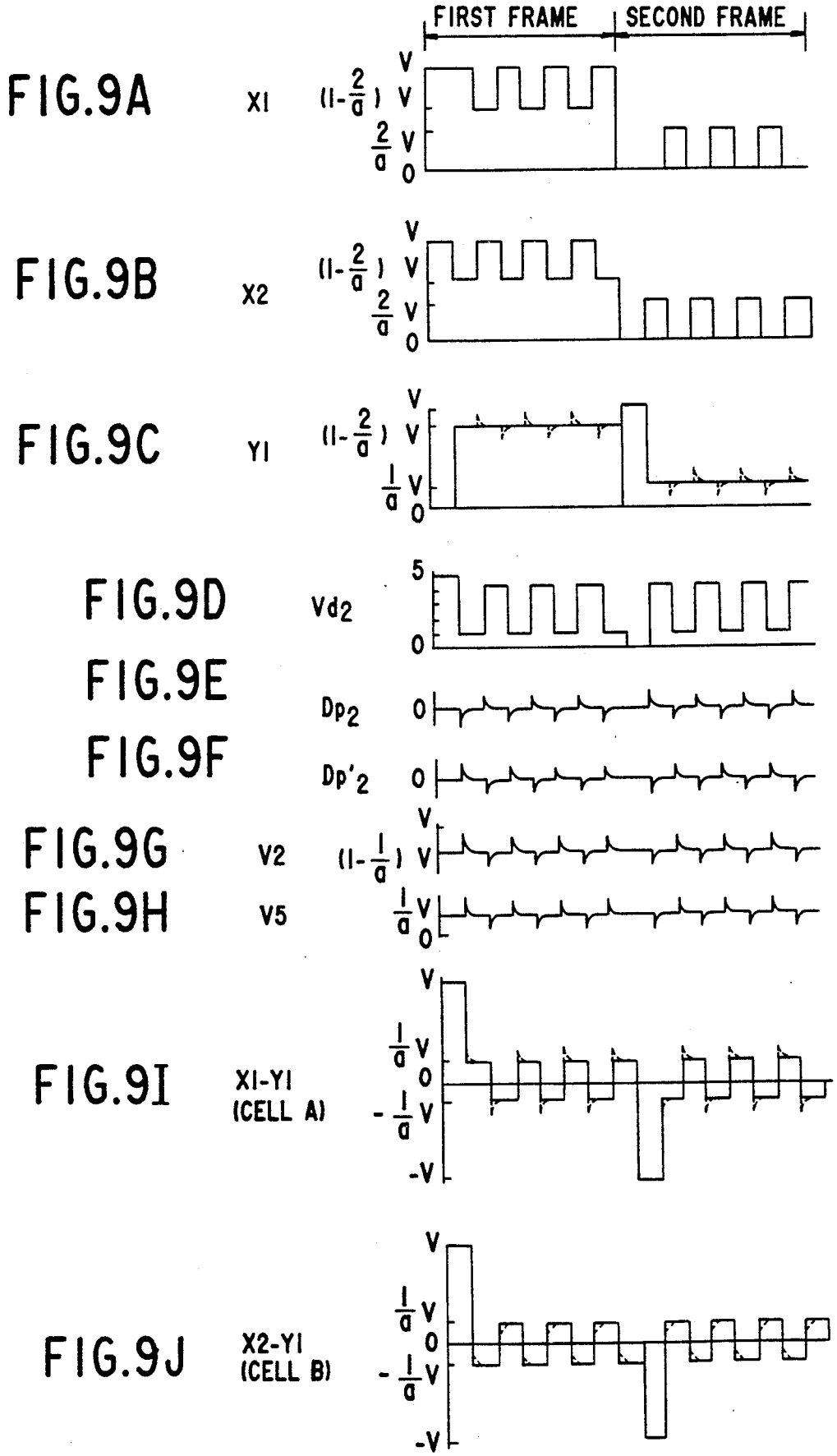
FIGS. 9A–J show voltage waveforms in the circuit of the FIG. 8 fourth preferred embodiment.

Voltage waveforms in the circuit of the fourth preferred embodiment for the display pattern of FIG. 4 are shown in FIGS. 9. In the first frame being in the positive voltage application mode, the quantity of ON-STATE cells on each of the scan electrodes $Y_1 \sim Y_8$ is respectively counted as 5, 1, 4, 1, 4, 1, 4 and 1 as seen in the pattern on FIG. 4. And, a DC voltage $V_d$ proportional to each of these numbers is generated. Then, a spike pulse $DP_2$ having its amplitude proportional to each of the changes in these DC voltages, i.e. the changes −4, 3, −3, 3, −3, 3 and −3, is output from the differentiating circuit 92. Then, in the same way as that of the first preferred embodiment, spike pulse $DP_2$ output from the differentiating circuit 92 is inverted and superposed onto the unselective scan voltages so as to cancel the undesirable spike pulse induced on the unselected scan electrodes illustrated with dotted lines in the figure. In the second frame being in the negative voltage application mode, the number of OFF-STATE cells on each of the scan electrodes $Y_1 \sim Y_8$ is respectively counted. All the other processes are the same as those of the first preferred embodiment. In a practical circuit, the level of the compensation pulse may be adjusted, for example, with a variable potentiometer (which is not shown in the figure), while the display panel is visually observed, and fixed.

Figure 10:
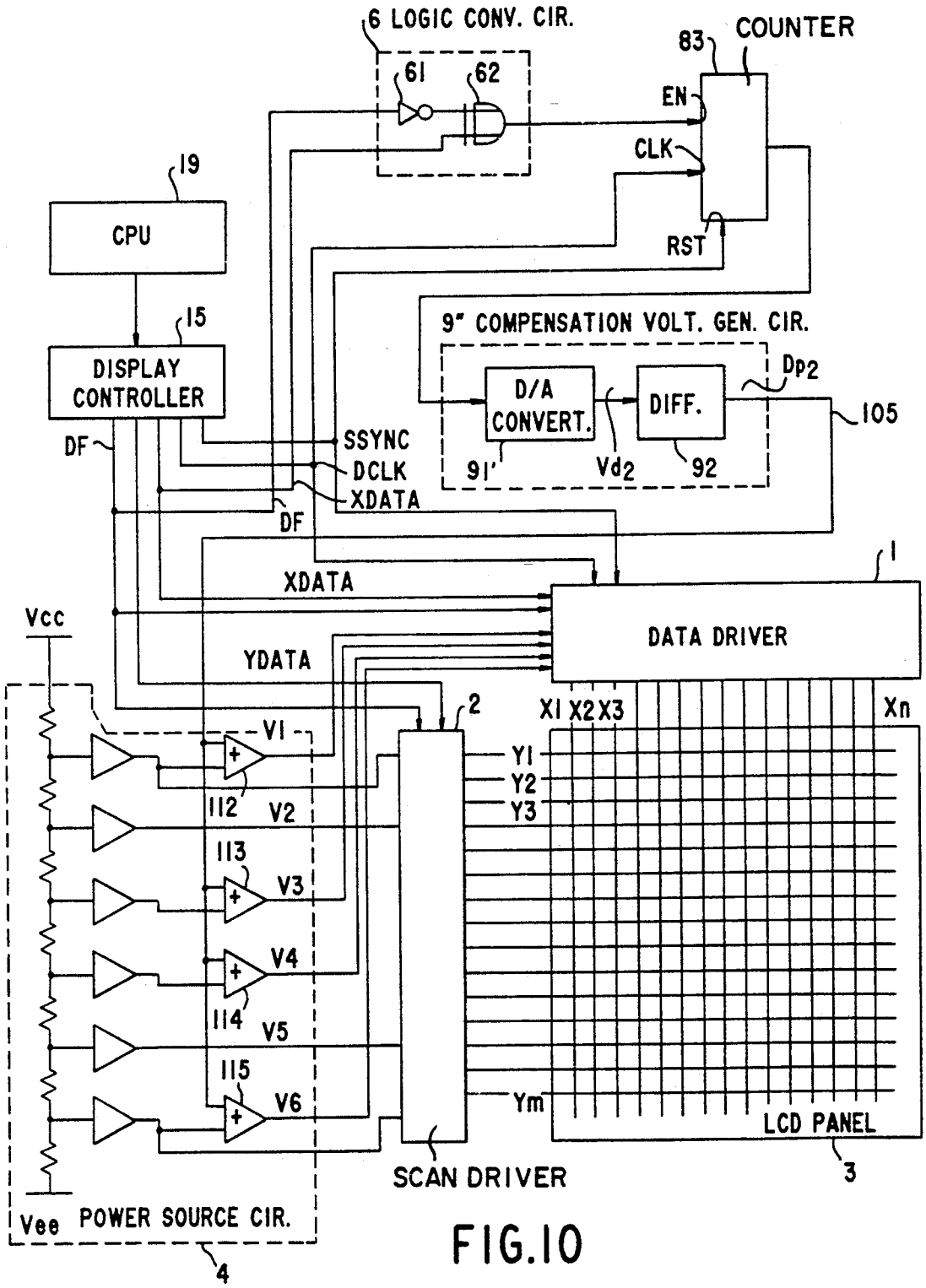
FIG. 10 is a block diagram of a fifth preferred embodiment of the present invention.

The fifth preferred embodiment of the present invention is shown in FIG. 10. Difference of the fifth preferred embodiment from the fourth preferred embodiment is the same as the difference of the second preferred embodiment from the first preferred embodiment. That is, the inverting circuit 101 has been deleted, and four adder circuits 112 ~ 115 are provided on power feeding lines for the DC voltage sources $V_1$ and $V_6$ to select the ON-STATE and the DC voltage sources $V_3$ and $V_4$ to select the OFF-STATE, to the data driver 1 instead of the scan driver 2. Accordingly, the compensation pulse $DP_2$ fed back to the power source circuit has the same polarity and the same amplitude as those of the undesirable spike induced on the unselected scan electrodes. Thus, none of the undesirable spike pulse appears on the cell voltages of the unselected cells. Other circuits being the same as in FIG. 8 are denoted with the same numerals so as to give no description thereon.

Figure 11:
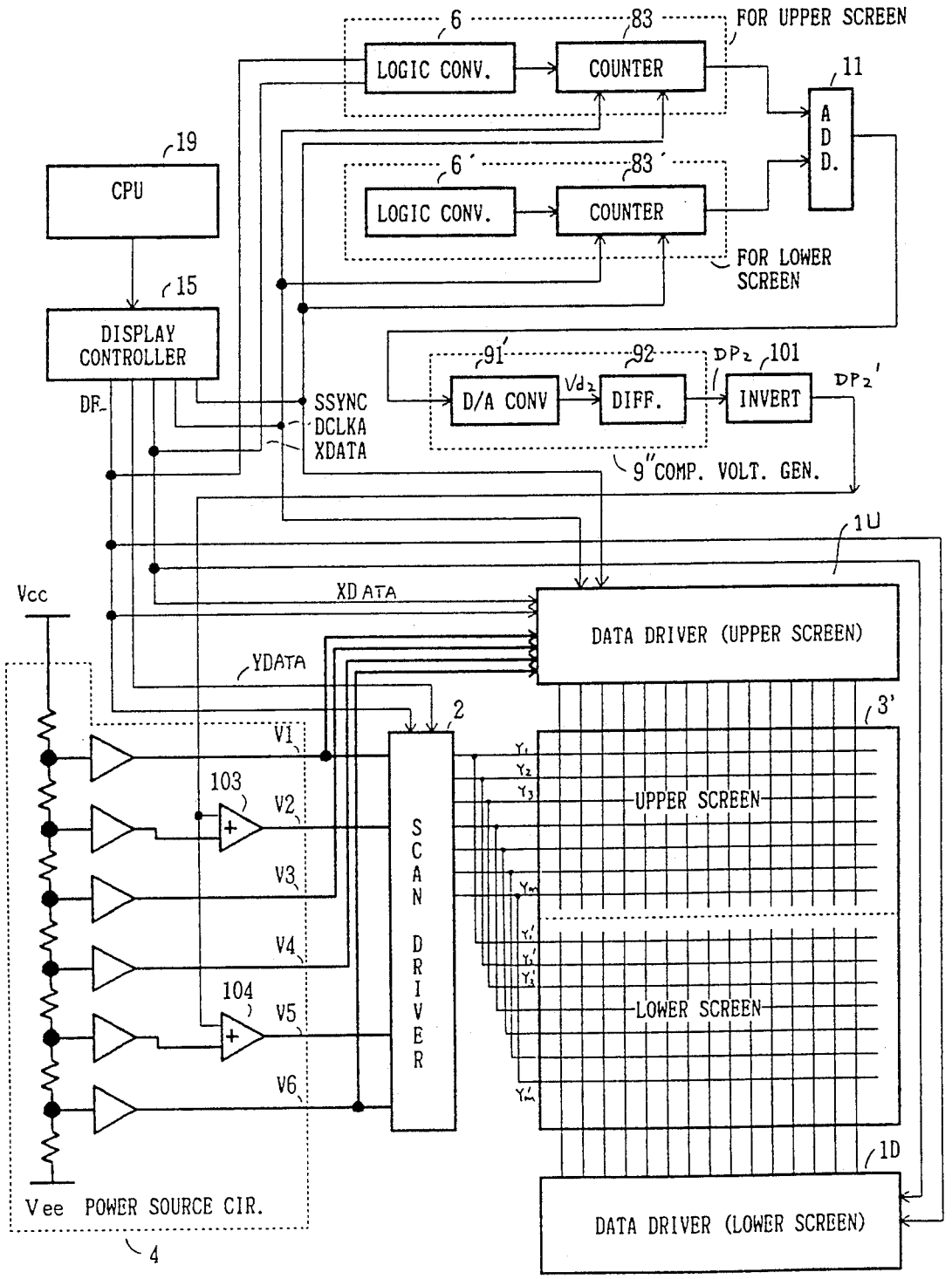
FIG. 11 is a block diagram of a sixth preferred embodiment of the present invention.

The sixth preferred embodiment of the present invention is shown in FIG. 11. In the sixth preferred embodiment the invention is embodied on a panel 3' having two screens, divided into an upper screen and a lower screen. Data electrodes for each screen are driven by independent data drivers 1U and 1D, respectively. Scan electrodes of an equal scan order on the upper and lower screens are connected to each other and commonly driven by the single scan driver 2. Therefore, the undesirable spike pulse is induced on the unselected scan electrodes of both the screens according to a change in the sum of the quantities of the ON-STATE or OFF-STATE cells displayed on the selected commonly-connected scan electrodes. In the sixth preferred embodiment, for the upper and lower screens 1U and 1D of the panel 3', independent logic converting circuits 6 and 6', independent counters 83 and 83' are respectively provided, and the adding circuit 11 composed of a decoder configuration, the compensation voltage generating circuits 9'' and the feedback circuit are commonly provided. The logic converting circuits 6 and 6', counters 83 and 83' and the compensation voltage generating circuits 9'' are respectively the same as those in the fourth preferred embodiment shown in FIG. 8. Quantities of the ON-STATE cells during the positive voltage application mode or OFF-STATE cells the negative voltage application mode, to be displayed on the commonly connected scan electrodes are counted respectively for the upper and the lower screens, in the same manner as that of the fourth preferred embodiment Thus counted quantities are summed by the adding circuit 11. A DC voltage $V_{d2}$ is generated in the D/A converter 91' in proportion to the summed quantity output from the adder circuit 11. A spike pulse $DP_2$ is generated in proportion to a change in the generated DC voltages $V_{d2}$ by the differentiating circuit 92. In the same way as that of the fourth preferred embodiment the spike pulse $DP_2$ is inverted by the inverter circuit 101 and fed back to the voltage sources of the scan electrodes, so as to cancel the undesirable spike pulses induced on the unselected scan electrodes.

For driving the divided screens, other variations than that shown in the FIG. 11 sixth preferred embodiment are possible as described below though no figures are shown therefor. The concept of the fifth preferred embodiment can be embodied in driving the divided screens. That is, the compensation voltage output from the compensation voltage generating circuit 9'' is fed back to each of the data drivers 1U and 1D so that the compensation voltage is superposed onto the data electrode voltages for selecting both the ON-STATE and OFF-STATE in the same polarity of the undesirable spike pulse induced on the unselected scan electrodes.

Any of the above-described concepts of the present invention can be embodied in a circuit configuration where independent plural scan drivers are provided for each of the divided screens. In the plural scan driver configuration the cross-talk caused by the undesirable spikes are independently suppressed on each of divided screens.

Figure 12:
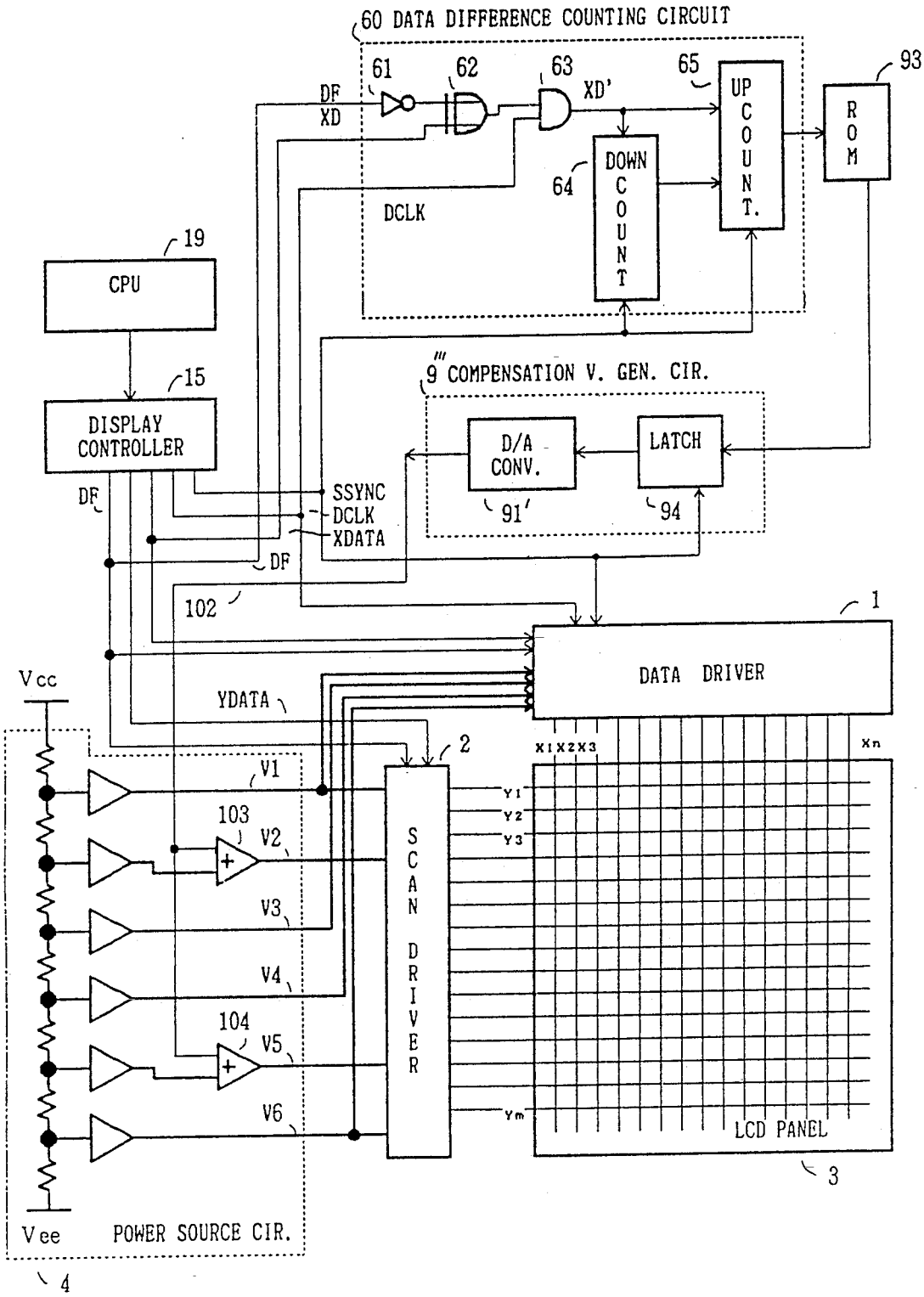
FIG. 12 is a block diagram of a seventh preferred embodiment of the present invention.
Figure 13:
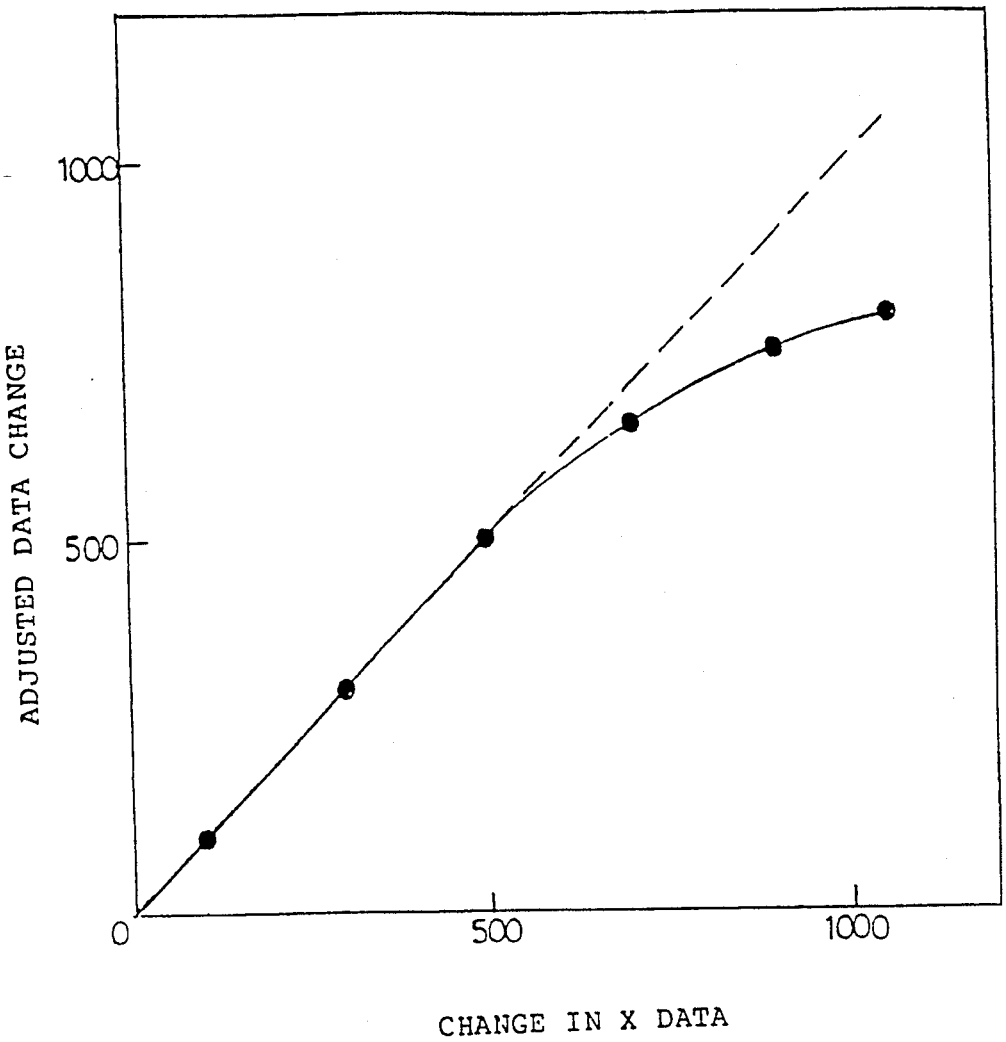
FIG. 13 is a table exhibiting an amount of adjusted compensation, employed in the seventh preferred embodiment.

The seventh preferred embodiment shown in FIG. 12, where though in the above-described preferred embodiments the compensation voltage is proportional to the change of the data to be displayed on each scan electrode, the compensation voltage may be adjusted according to a predetermined relation other than the above-described proportional relation. A conversion table 93 composed of a ROM (read only memory) and latch 94 are serially added between a data difference counting circuit 60 and D/A converter 91'. The data difference counting circuit 60 will be described in detail later on, however functions the same as the logic converting circuit 6, the line memory 7 and the data difference detecting circuit 8 of the first preferred embodiment shown in FIG. 1. Accordingly, the output of the data difference counting circuit 60 is a change in the quantity of the logic level "1" data (representing ON-STATE bits to be displayed on a scan electrode during the positive voltage application mode, as well as representing OFF-STATE bits during the negative voltage application mode) from the previous scan electrode $Y_{i-1}$ into the present scan electrode $Y_i$. The amount of adjustment of the compensation is given in a graph shown in FIG. 13, i.e. the relation of the above-described change in the counted X data of the presently selected scan electrode $Y_i$ from the just prior scan electrode $Y_{i-1}$ versus a quantity to be input to D/A converter 91. ROM 93 outputs thus adjusted quantity according to the data change quantity input thereto. The latch 94 stores the adjusted data serially output from the ROM 93, and outputs the corresponding stored data to the D/A converter 91' in synchronization with the scan synchronizing signal SSYNC selecting the present scan electrode $Y_i$. Output from the D/A converter 91' is processed in the same way as in the third preferred embodiment shown in FIG. 6. Consequently, thus adjusted compensation voltage properly provides better cancellation of the cross-talk on the panel caused from the undesirable spike pulses induced on the unselected scan electrodes. The conversion table shown in FIG. 13 is an example for a particular panel; therefore, the conversion table may be modified depending on the panel and the circuit employed thereto. In a practical circuit, the level of the fed-back compensation voltage may be adjusted, for example, with a variable potentiometer (which is not shown in the figure), while the display panel is visually observed, and fixed.

As is described above, the data difference counting circuit 60 functions identically to the corresponding circuits of the first preferred embodiment, however, is different in structure as shown in FIG. 12. Constitution and operation of the data counting circuit 60 are hereinafter described in detail. Inverter 61 and exclusive OR gate 62 are identical to those of the first preferred embodiment, so that, a logical level "1" in the X data XD is output as a logical level "1" from the exclusive OR-gate 62 during a positive voltage application mode. During a negative voltage application mode, a logical level "0" in the X data is output as a logical level "1" from the exclusive OR gate 62. The logical level "1" output from the exclusive OR gate 62 is enabled by an AND gate 63 with a clock pulse DCLK so as to be input to a down-counter 64 and an up-counter 65, and is down-counted and up-counted respectively therein. It is now assumed that a quantity of ON-STATE bits in X data $XD_{i-1}'$ for scan electrode $Y_{i-1}$ during a positive voltage application mode is 30. Then, the count-number counted by the down-counter 64 becomes −30, because the down-counting was started from 0. Prior to starting the counting of data for the present scan electrode $Y_i$, the counted number −30 is input, as an initial number, to the up-counter 65. Next, the up-counter 64 up-counts X data $XD_i$ for the next scan electrode $Y_i$ from −30. Therefore, if the quantity of ON-STATE bits on scan electrode $Y_i$ is 100, the final count number of the up-counter 65 becomes 70. Thus, the up-counter 65 outputs difference of the quantities of the level "1" bits between the just prior scan electrode $Y_{i-1}$ and the presently selected scan electrode $Y_i$.

Though two types of data counting circuits, i.e. the first type composed of logic converting circuit 6, line memory 7, data difference detecting circuit 8 and up-down counter 82 shown in FIG. 1, FIG. 5 and FIG. 6, and the second type denoted with the numeral 60 in FIG. 12, it is apparent that many other circuit constitutions are possible as long as the function is equivalent.

Though the seventh preferred embodiment is described as a variation of the first preferred embodiment, it is apparent that the method of the seventh preferred embodiment may be embodied in other circuits, such as the second and the third preferred embodiments.

Figure 14:
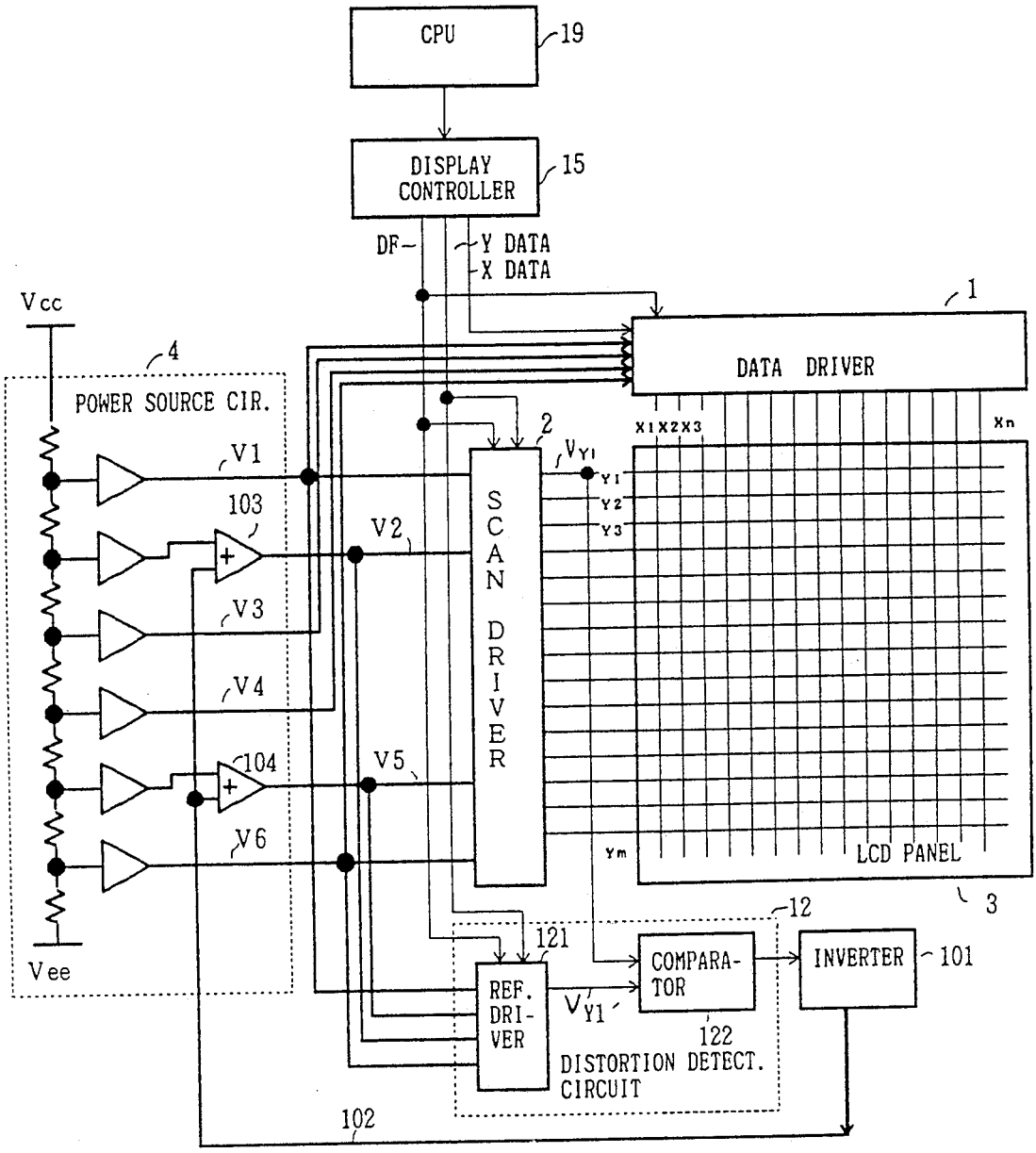
FIG. 14 is a block diagram of a eighth preferred embodiment of the present invention.
Figures 15A, 15B, 15C, 15D, 15E, 15F, 15G, 15H, 15I:
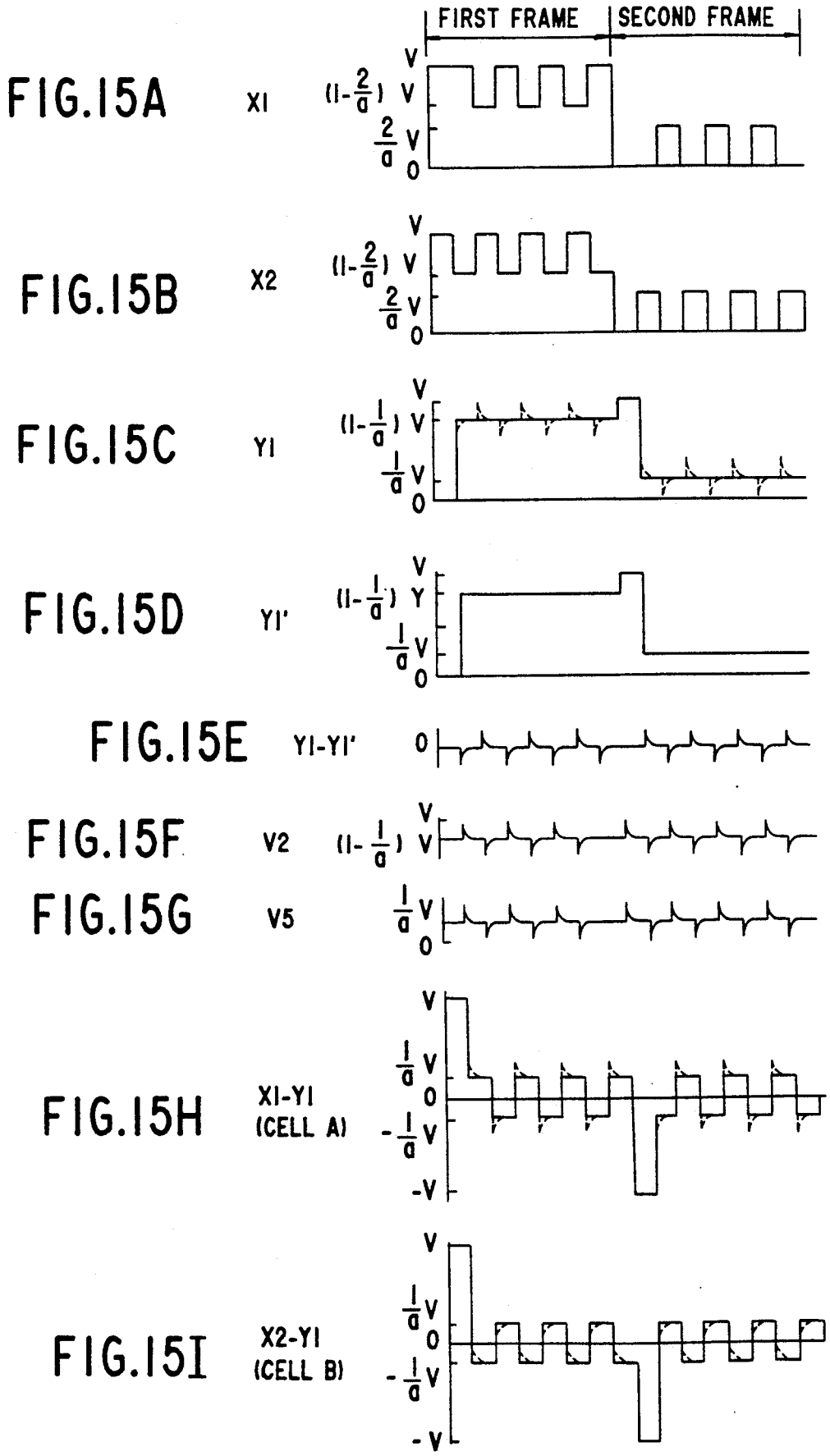
FIGS. 15A–I show voltage waveforms in the circuit of the FIG. 14 eighth preferred embodiment.

Furthermore, referring to FIG. 14, the eighth preferred embodiment, which is another method and circuit for cancelling the undesirable spikes induced on unselected scan electrodes, is hereinafter described in detail. Difference of the eighth preferred embodiment from the first preferred embodiment is in that the compensation voltage, which is fed back to the scan electrodes so as to cancel the undesirable spike induced on the scan electrodes voltages, is detected from one of the scan electrodes. Accordingly, for the eighth preferred embodiment the logic converting circuit 6, line memory 7, the data difference detecting circuit 8 and the compensation voltage generating circuit 9 have been deleted from the circuit configuration of the FIG. 1 first preferred embodiment, and a distortion detecting circuit 12 is newly added. Selective and unselective voltages applied to the data electrodes and the scan electrodes are identical to those of the first preferred embodiment. Distortion detecting circuit 12 comprises a reference driver 121, a comparator 122 and an inverter 101. A first input terminal of the comparator 122 is connected to one of the scan electrodes, $Y_1$, as a sampling electrode. Six input terminals of the reference driver 121 are input with the same inputs as those to the scan driver 2, that is, four voltages $V_1$, $V_2$, $V_5$ and $V_6$, Y data and the mode selecting signal DF. The reference driver 121 selectively outputs, to a second input terminal of the comparator 122, a reference voltage $V_{Y1}$, whose waveform is identical to a voltage to be supplied to the above-described sampling electrode $Y_1$, that is, 0 or (1-1/a)V volt during a positive voltage application mode, as well as V or (1/a)V volt during a negative voltage application mode. On the other hand, an undesirable spike is induced on the voltage of the sampling electrode $Y_1$ by a current from the cells connected thereto caused by an application of data voltages from the data driver 1. Thus, the comparator 122 compares the voltage $V_{Y1}$ of the sampling electrode Y1 including the undesirable spike with the reference voltage $V_{Y1}'$ output of the reference driver 121 so as to output their difference ($V_{Y1}-V_{Y1}'$), which is a distortion, i.e. the induced spike component. The output from the comparator 122 is inverted in its polarity by the inverter 101. This inverted signal is a compensation voltage having the same waveform and an opposite polarity to the undesirable spike, and is fed back to the scan driving voltages $V_2$ and $V_5$ via the adder circuits 103 and 104, in the same way as the first preferred embodiment. Voltage waveforms, for displaying the pattern of FIG. 3, generated in the FIG. 14 circuit are shown in FIG. 15. In FIG. 15 it is observed that the undesirable spikes illustrated with dotted lines are cancelled as shown with solid lines. Though not shown on a figure, the compensation voltage output from the comparator 122 may be fed back to the data driver 1 in the same way as the modification of the first preferred embodiment to the FIG. 5 second preferred embodiment. In a practical circuit, the level of the fed-back compensation pulse may adjusted, for example, with a variable potentiometer (which is not shown in the figure), while the display panel is visually observed, and fixed.

Though in the above-described preferred embodiments, an inverter 101 is provided to feedback the compensation voltage to scan electrodes, the inverter may be deleted when the D/A converter 91, the differentiator 92 or the comparator 122 is of such type that outputs an already inverted compensation voltage onto the feedback line 102 or 105.

Still furthermore, referring to FIG. 16, the ninth preferred embodiment of the present invention is hereinafter described, which is an improvement of the above-described compensation voltage generating circuit 9, 9', 9'' and 9''' in the case where the above-described first to eighth preferred embodiments are provided with a brightness control circuit. Though in the above-described preferred embodiments no description has been given on the brightness of the ON-STATE cell, a practical display drive circuit is provided with a brightness control circuit so as to meet the enviromental brightness condition. The brightness control circuit is composed of a potentiometer type variable resistor VR1. One of fixed terminals of the variable resistor VR1 is connected to a power source $V_{cc}$ and another fixed terminal is grounded. The variable terminal outputs a brightness control voltage $V_{LCD}$ as a power source voltage to the power source circuit 4. Thus, each voltage to drive the scan electrodes and the data electrodes is variably set so as to set the cell voltages. An increased brightness control voltage $V_{LCD}$ increases the cell voltage, resulting in an increase in the cell brightness. Contrary, a decreased brightness control voltage $V_{LCD}$ decreases the cell voltage, resulting in a decrease in the cell brightness. However, because of the cross-talk the above-described effect of adjusting the brightness control voltage $V_{LCD}$ is not always equal on the bright cells, as shown in FIG. 17 where curves "A" and "B" represent the optical transparency, i.e. the brightness, of ON-STATE of the cells "A" and "B" shown in FIG. 4 pattern, versus the brightness control voltage $V_{LCD}$. As seen in FIG. 17, the gradient of the curves are not equal, that is, curve "B" of cell "B" whose brightness is decreased by the cross-talk is less steep than curve "A" of cell "A" whose brightness is increased by the cross-talk. Brightness of the two cells "A" and "B" is equal only at the intersection of two curves "A" and "B", where the brightness control voltage is $V_{LCD1}$. At the other brightness control voltages than $V_{LCD1}$, the cross-talk takes place on both the cells "A" and "B". In other words, in the above-described preferred embodiments the cross-talk can be cancelled only when the brightness control voltage is set at $V_{LCD1}$.

Figure 16:
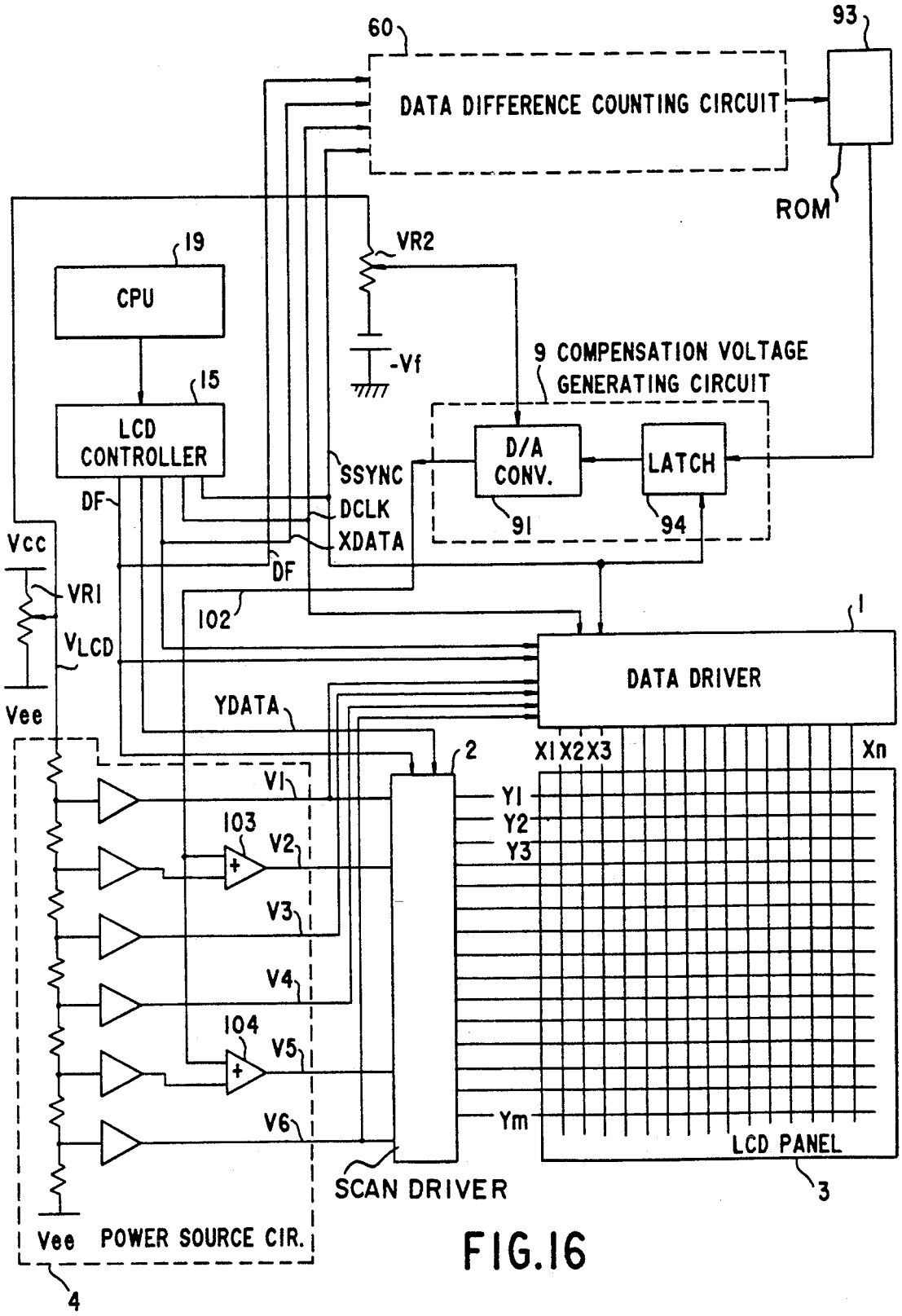
FIG. 16 is a block diagram of a ninth preferred embodiment of the present invention.
Figure 17:
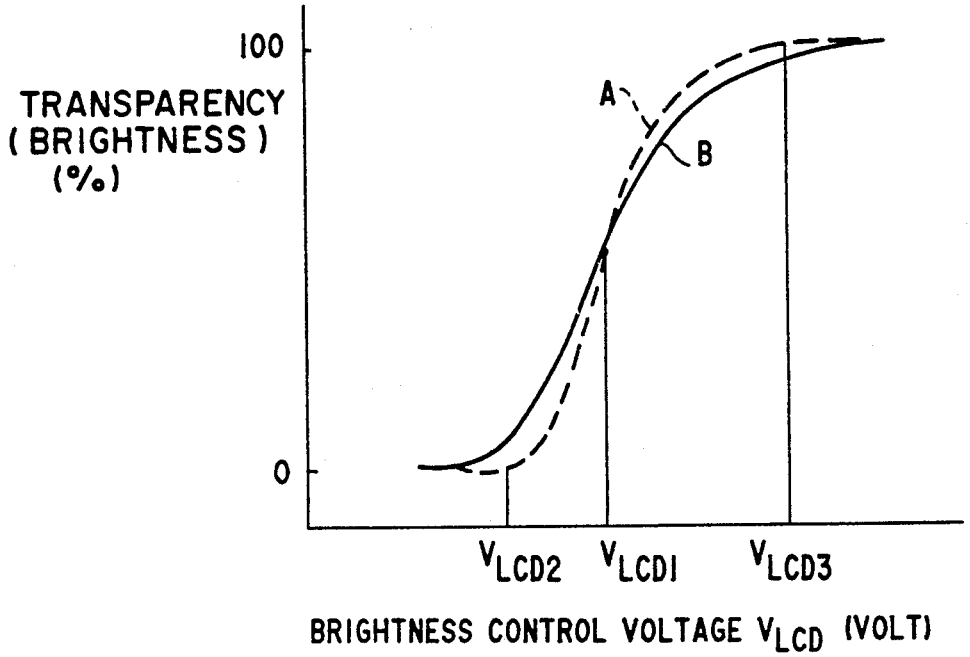
FIG. 17 shows relation of cell brightness versus brightness control voltage.
Figure 18:
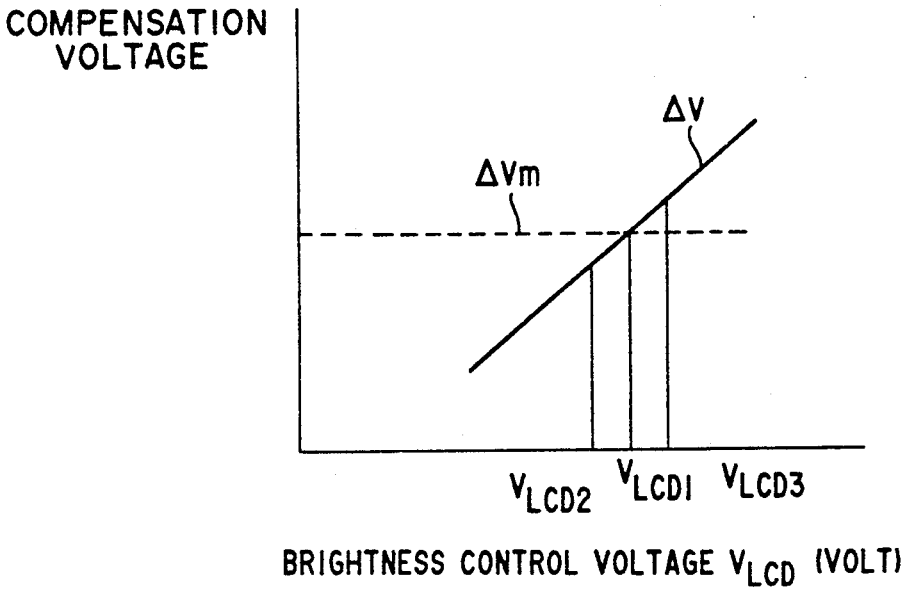
FIG. 18 shows relation of adjusted compensation voltage versus brightness control voltage, embodied in the ninth preferred embodiment.

In order to perfectly prevent the above-described cross-talk problem even when the brightness control voltage is varied, in the FIG. 16 ninth preferred embodiment the compensation voltage introduced in the above-described preferred embodiments is adjusted depending on the brightness control voltage as shown in FIG. 18. That is, at a brightness control voltage $V_{LCD3}$ which is higher than $V_{LCD1}$ the compensation voltage is adjusted to become larger, and at a brightness control voltage $V_{LCD2}$ lower than $V_{LCD1}$ the compensation voltage is adjusted to become lower. Amount of the adjusted compensation voltage ΔV is given by formula:

$$\Delta V = \Delta Vm\ k\ (V_{LCD1} - V_f)$$

where ΔVm indicates the compensation voltage before the adjustment, i.e. compensation voltage introduced in the above-described first to eighth preferred embodiments; K indicates a constant; and $V_f$ indicates a predetermined constant voltage which determines the location of the curve V with respect to the brightness control voltage $V_{LCD}$ in FIG. 18. Thus adjusted compensation voltage ΔV adjusts the curves "A" and "B" to have an equal gradient, so that both the cells "A" and "B" have no cross-talk take place thereon, respectively. Circuit configuration for generating this adjusted compensation voltage ΔV is shown typically in FIG. 16. There is provided a potentiometer type variable resistor VR2 whose one of fixed terminals is connected to the brightness control voltage $V_{LCD1}$ and another fixed terminal is connected to a constant DC voltage source having an output voltage $-V_f$. The variable terminal outputs a power source voltage to be applied to the D/A converter 91, whose DC output voltage varies in accordance with the applied power source voltage thereto. Thus, the compensation voltage output from the D/A converter is adjusted according to the above described formula. The variable potentiometer which may be employed for adjusting the compensation voltage level in the first to eighth preferred embodiments is unnecessary in the FIG. 16 ninth preferred embodiment.

It is apparent that the FIG. 16 ninth preferred embodiment may be embodied in combination with any of the above-described preferred embodiments, though no drawing nor description is particularly given thereon.

As is described above, according to the present invention, in driving a direct drive matrix type liquid crystal display, there is provided an advantageous effect in that an undesirable display irregularity caused from cross-talk of data signal onto scan drive voltage can be suppressed, so that the display quality can be improved.

The many features and advantages of the invention are apparent from the detailed specification and thus, it is intended by the appended claims to cover all such features and advantages of the system which fall within the true spirit and scope of the invention. Further, since numerous modifications and changes may readily occur to those skilled in the art, it is not desired to limit the invention to the exact construction and operation shown and described, and accordingly, all suitable modifications and equivalents may be resorted to, falling within the scope of the invention.

What we claim is:

1. A liquid crystal display device for displaying an image of a display data signal, comprising:

a liquid crystal display including a plurality of data electrodes, a plurality of scan electrodes, and a plurality of liquid crystal cells arranged in a matrix between said plurality of data electrodes and said plurality of scan electrodes, the data electrodes and the scan electrodes extending transversely to each other; each of said plurality of liquid crystal cells having an ON-STATE and an OFF-STATE each determined by a magnitude of cell voltage applied thereto, said cell voltage applied to each of said plurality of liquid crystal cells being controlled by voltages of an adjacent one of said data electrodes and a traversing one of said scan electrodes at said cell; said cell voltage being in a first polarity during a first voltage application mode and being in a second polarity opposite to said first polarity during a second voltage application mode;

mode selecting means for outputting a mode selecting signal which alternately selects one of said first and second voltage application modes, so as to cyclically switch between said first and second voltage application modes;

power source means for supplying selecting voltages to select said ON-STATE for said first and second voltage application modes, respectively, and for supplying unselective voltages to select said OFF-STATE for said first and second voltage application modes, respectively;

scan driver means receiving a scan signal of said display data signal and said mode selecting signal, for selectively applying said selective and unselective voltages to each of said scan electrodes, to select said selective and unselective voltages in synchronization to said scan signal, polarity of said applied voltage being dependent upon said mode selecting signal;

data driver means receiving said display data signal and said mode selecting signal, for selectively applying said selective and unselective voltages output from said power source means to said data electrodes, to select said selective and unselective voltages according to said display data signal, polarity of said applied voltage being in response to said mode selecting signal;

determining means for determining an induced voltage on unselected ones of said plurality of scan electrodes;

compensation voltage generating means for generating a compensation voltage having a magnitude approximately equal to the induced voltage; and feedback means for inverting and superposing said compensation voltage onto voltages to be supplied via said scan driver to the unselected ones of said plurality of scan electrodes, and said feedback means including adding circuit means for adding the inverted compensation voltage to said unselective voltage applied by said scan driver means to the unselected ones of said plurality of scan electrodes.

2. A liquid crystal display device as claimed in claim 1, where said feedback means includes an invertor which inverts the output of said compensation voltage generating means.

3. A liquid crystal display device as claimed in claim 1, wherein said adding circuit means comprises first and second adders which add said inverted compensation voltage to said unselective voltage which is applied by said scan driver means to the unselected ones of said plurality of scan electrodes.

4. A liquid crystal display device for displaying an image of a display data signal, comprising:

a liquid crystal display including a plurality of data electrodes, a plurality of scan electrodes, and a plurality of liquid crystal cells arranged in a matrix between said plurality of data electrodes and said plurality of scan electrodes, the data electrodes and the scan electrodes extending transversely to each other; each of said plurality of liquid crystal cells having an ON-STATE and an OFF-STATE each determined by a magnitude of cell voltage applied thereto, said cell voltage applied to each of said plurality of liquid crystal cells being controlled by voltages of an adjacent one of said data electrodes and a traversing one of said scan electrodes at said cell; said cell voltage being in a first polarity during a first voltage application mode and being in a second polarity opposite to said first polarity during a second voltage application mode;

mode selecting means for outputting a mode selecting signal which alternately selects one of said first and second voltage application modes, so as to cyclically switch between said first and second voltage application modes;

power source means for supplying selecting voltages to select said ON-STATE for said first and second voltage application modes, respectively, and for supplying unselective voltages to select said OFF-STATE for said first and second voltage application modes, respectively;

scan driver means receiving a scan signal of said display data signal and said mode selecting signal, for selectively applying said selective and unselective voltages to each of said scan electrodes, to select said selective and unselective voltages in synchronization to said scan signal, polarity of said applied voltage being dependent upon said mode selecting signal;

data driver means receiving said display data signal and said mode selecting signal, for selectively applying said selective and unselective voltages output from said power source means to said data electrodes, to select said selective and unselective voltages according to said display data signal, polarity of said applied voltage being in response to said mode selecting signal;

determining means for determining an induced voltage on unselected ones of said plurality of scan electrodes;

compensation voltage generating means for generating a compensation voltage having a magnitude approximately equal to the induced voltage;

feedback means for inverting and superposing said compensation voltage onto voltages to be supplied via said scan driver to the unselected ones of said plurality of scan electrodes; and said feedback means including an invertor which inverts the output of said compensation voltage generating means, and adding circuit means for adding the inverted compensation voltage to said unselective voltage applied by said scan driver means to the unselected ones of said plurality of scan electrodes.

5. A liquid crystal display device for displaying an image of a display signal, comprising:

a liquid crystal display including a plurality of data electrodes, a plurality of scan electrodes, and a plurality of liquid crystal cells arranged in a matrix between said plurality of data electrodes and said plurality of scan electrodes, the data electrodes and the scan electrodes extending transversely to each other; each of said plurality of liquid crystal cells having an ON-STATE and an OFF-STATE each determined by a magnitude of cell voltage applied thereto, said cell voltage applied to each of said plurality of liquid crystal cells being controlled by voltages of an adjacent one of said data electrodes and a traversing one of said scan electrodes at said cell; said cell voltage being in a first polarity during a first voltage application mode and being in a second polarity opposite to said first polarity during a second voltage application mode;

mode selecting means for outputting a mode selecting signal which alternately selects one of said first and second voltage application modes, so as to cyclically switch between said first and second voltage application modes;

power source means for supplying selective voltages to select said ON-STATE for said first and second voltage application modes, respectively, and for supplying unselective voltages to select said OFF-STATE for said first and second voltage application modes, respectively;

scan driver means receiving a scan signal of said display data signal and said mode selecting signal, for selectively applying said selective and unselective voltages to each of said scan electrodes, to select said selective and unselective voltages in synchronization to said scan signal, polarity of said applied voltage being dependent upon said mode selecting signal;

data driver means receiving said display data signal and said mode selecting signal, for selectively applying said selective and unselective voltages output from said power source means to said data electrodes, to select said selective and unselective voltages according to said display data signal, polarity of said applied voltage being in response to said mode selecting signal;

determining means for determining an induced voltage on unselected ones of said plurality of scan electrodes;

compensation voltage generating means for generating a compensation voltage having a magnitude approximately equal to the induced voltage;

feedback means for inverting and superposing said compensation voltage onto voltages to be supplied via said scan driver to the unselected ones of said plurality of scan electrodes;

a display control means for producing a display data signal to said data driver means; and wherein said determining means comprises a logic converter circuit receiving as inputs said mode selecting signal and said display data signal from said display control means;

a counter connected to receive output from said display control means; and said display control means outputs a data synchronizing signal to said counter, and said counter further comprises an enable terminal, wherein said output of said logic converter circuit is received at said enable terminal.

6. A liquid crystal display device as claimed in claim 5, wherein said determining means further comprises a counter which receives the output of said logic converter circuit.

7. A liquid crystal display device as claimed in claim 5, wherein said display control means produces a scan synchronizing signal, and said counter further comprises a reset terminal, wherein said scan synchronizing signal from said display control means is received at said reset terminal of said counter for resetting the count registered by said counter.

8. A liquid crystal display device as claimed in claim 7, wherein said counter is an up/down counting means.

* * * * *